US008227776B2

(12) United States Patent
Hikosaka et al.

(10) Patent No.: US 8,227,776 B2
(45) Date of Patent: Jul. 24, 2012

(54) ELECTRON BEAM IRRADIATING APPARATUS WITH MONITORING DEVICE

(75) Inventors: Tomoyuki Hikosaka, Ichihara (JP); Shiro Eguchi, Nishi-Shinbashi (JP); Takayuki Suzuki, Ichihara (JP); Nobuyasu Harada, Ichihara (JP); Satoru Gohzaki, Ichihara (JP); Shigekatsu Sato, Hitachi (JP); Isao Hashimoto, Hitachi (JP)

(73) Assignee: Japan AE Power System Corporation, Tokyo (JP)

( * ) Notice: Subject to any disclaimer, the term of this patent is extended or adjusted under 35 U.S.C. 154(b) by 41 days.

(21) Appl. No.: 12/992,036

(22) PCT Filed: May 1, 2009

(86) PCT No.: PCT/JP2009/058877

§ 371 (c)(1),
(2), (4) Date: Nov. 10, 2010

(87) PCT Pub. No.: WO2009/139399

PCT Pub. Date: Nov. 19, 2009

(65) Prior Publication Data

US 2011/0062351 A1 Mar. 17, 2011

(30) Foreign Application Priority Data

May 12, 2008 (JP) ..... 2008-124495

(51) Int. Cl.
*G21K 5/04* (2006.01)

(52) U.S. Cl. ..... 250/492.3

(58) Field of Classification Search ..... 250/492.3, 250/492.1

See application file for complete search history.

(56) References Cited

U.S. PATENT DOCUMENTS

2006/0138352 A1* 6/2006 Tanaka ..... 250/492.3

FOREIGN PATENT DOCUMENTS

| | | |
|---|---|---|
| JP | 08-265738 | 10/1996 |
| JP | 08-313700 | 11/1996 |
| JP | 11-084099 | 3/1999 |
| JP | 2001-166099 | 6/2001 |
| JP | 2002-090499 | 3/2002 |
| JP | 2005-121925 | 5/2005 |

* cited by examiner

*Primary Examiner* — Kiet T Nguyen
(74) *Attorney, Agent, or Firm* — Brundidge & Stanger, P.C.

(57) ABSTRACT

The electron beam irradiating apparatus with the monitoring device has an electron beam irradiating means for irradiating materials in an irradiation chamber. The monitoring device has a photographing means for imaging a lights emitted by irradiating an electron beam to the materials; a storage means that stores state of electron beam irradiation in advance; and a calculating means that processes an image, which is captured by the photographing means, to decide a state of electron beam irradiation. The storage means has stored at least three state of electron beam irradiation and also has stored image luminance associated with those states of electron beam irradiation. The calculating means loads the image, which is captured by the photographing means, to compare the loaded image with the image luminance stored in the storage means, thereby deciding a state of electron beam irradiation.

10 Claims, 16 Drawing Sheets

ELECTRON BEAM IRRADIATING APPARATUS WITH MONITORING DEVICE

TECHNICAL FIELD

The present invention relates to an electron beam irradiating apparatus with monitoring device particularly to such an electron beam irradiating apparatus equipped with such a monitoring device as is suitable for keeping track of the irradiation state of a materials, which is under irradiation of electron beam emitted from the electron beam irradiation means, to decide causes of electron beam abnormalities individually when occurred.

BACKGROUND ART

Electron beam irradiation apparatuses mostly use monitoring devices to check electron beam irradiation state for uniform irradiation of target objects for correct sterilization.

As a conventional art for keeping track of state of electron beam irradiation, JP 08-265738 A1 (Patent Literature 1) has described an invention, in which lights emitted on irradiation of an irradiation target with electron beam is photographed and the photographed lights are image processed for its intensity distribution to see the electron beam irradiation state.

As an art that decides abnormality in the electron beam irradiation state by detecting broken filament, JP 11-84099 A1 (Patent Literature 2) has described an invention, in which plural filaments grouped into two are arranged so that direction of current flow through each group will be mutually opposite and the difference between these currents is measured with a current transformer checking for balancing state of currents; and thereby the state is judged to be broken filament in the event when the current balance is lost.

Further, JP 08-313700 A1 (Patent Literature 3) has described another invention for an electron beam source. The invented electron beam source has a state detector that detects temperature of the irradiation window thereof while the source is in operation. The life of an irradiation window is diagnosed based on the data of the state of the irradiation window loaded by the state detector. Information derived from the detected temperature rise and temperature distribution of the irradiation window to track the dose and irradiation distribution of the electron beam is fed-back to the electron gun control circuit and electromagnet for regulating irradiation area through a feedback circuitry to permit the electron beam source to keep running within the tolerance free from the breakage of the irradiation window.

In addition to the above, an invention for a method of deciding the abnormality in an image processing system has been described in JP 2005-121925 A1 (Patent Literature 4). In the invented method, image data is binarized into a bright part and a dark part and into which range among the plural ranges of threshold values the luminance of a specific position falls is examined to decide the cause of the abnormality in the illumination lighting source or imaging apparatus of the image processing system.

Although the art defined in Patent Literature 1 judges whether the electron beam irradiation is normal or abnormal, features related to determination of cause of abnormality when the electron beam irradiation is judged abnormal is not disclosed. For example, how to decide whether the abnormality is caused from either the broken filament or attributable to the vacuum window is not disclosed. Therefore, when the state is judged abnormal in the art defined in Patent Literature 1, the operation of the electron beam irradiation equipment must be stopped to undergo checking all the abnormality-questionable sections before resuming operation. This means it is likely that the checking will consume much time.

With the art defined in Patent Literature 2, the broken filament is detected instantly. However, the Literature does not disclose features related to detection of abnormality due to unusualness of the vacuum window or axis deviation. This means that detection of electron beam irradiation abnormality is difficult in the art defined in Patent Literature 2 even though unusualness of the vacuum window or axis deviation occurs, unless the broken filaments; and consequently that the irradiation target is likely to finish sterilization process without knowing dose is insufficient.

The art defined in Patent Literature 3 diagnose the life of an irradiation window based on the temperature rise and temperature distribution thereof derived from the measurements of the temperature of the irradiation window. This means that the art does not consider any cause of abnormality attributable to those other than the irradiation window, although the abnormality of the irradiation window can be detected. To enable decision of causes of abnormality resulted from broken filament or axis deviation, it is necessary to provide another detector for such purpose separately. Therefore, a system by the art has involved such a problem that rigging additional detector may invite an anxiety of the system being complicated.

The art defined in Patent Literature 4 decides the cause of abnormality by applying threshold value processing to the image data, in which the determination handles abnormalities of the lights source lamp for illuminating imaging objects and the imaging apparatus. Therefore, the art is not such a technique as observes luminance of lights emitted from an object under irradiation with electron beam, performs threshold value processing, and decides the cause of the abnormality in the state of the electron beam irradiation. In other words, the defined art does not specifically identify which section of the electron beam irradiation means has the cause of the abnormality.

In view of above stated problems, the present invention aims to provide an electron beam irradiating apparatus with monitoring device. The invented apparatus is capable of not only deciding whether the electron beam irradiation is normal or abnormal but also identifying the causes of abnormalities when occurred; the apparatus thereby shortens the time required to perform a check operation. The apparatus is further capable of deciding the causes for plural abnormalities with single device relying on luminance of images stored in a storage means.

DISCLOSURE OF INVENTION

An electron beam irradiating apparatus with monitoring device pertinent to claim 1 has an electron beam irradiation means irradiating materials in an irradiation chamber with electron beam, the electron beam being generated by accelerating thermal electrons, the thermal electrons being emitted from a plurality of filaments; a photographing means capturing the lights emitted by the irradiated materials; a storage means storing states of electron beam irradiation in advance; a calculating means processing the image captured by the photographing means to decide the state of electron beam irradiation stored in the storage means. The storage means stores luminance of the images that correspond to the states of electron beam irradiation, and stores at least three states of electron beam irradiation selected from a group consisting of normal, axis deviation, broken filament, and vacuum window deterioration. The calculating means loads the image captured by the photographing means to compare the loaded image with the luminance of the image stored in the storage means, reads the states of electron beam irradiation related to the luminance of images stored in the storage means, and thereby decides state of electron beam irradiation. The states of electron beam irradiation stored in the storage means are decided by selecting optional three states of electron beam irradiation from the group consisting of normal, axis deviation, broken filament, and vacuum window deterioration. As the luminance of the image that corresponds to the state of electron beam irradiation stored in the storage means, the threshold values defined by quantifying the luminance data and the emitted light luminance each corresponding to at least three states of electron beam irradiation are used. In the calculating means, the stored image is compared with the image captured by the photographing means to decide the state of electron beam irradiation by finding a matched data from among stored luminance data of images. When a threshold value is used for the luminance of the image, the calculating means compares the value of the emitted light luminance with the threshold value and decides the state of electron beam irradiation according to the comparison result: the value of the emitted light luminance being above or below the threshold value. On processing the captured image, the calculating means is to make necessary correction depending on the installation position of the photographing means.

An electron beam irradiating apparatus with monitoring device pertinent to claim 2 has an electron beam irradiation means irradiating materials in an irradiation chamber with electron beam, the electron beam being generated by accelerating thermal electrons, the thermal electrons being emitted from a plurality of filaments; a photographing means capturing the lights emitted by the irradiated materials; a storage means storing states of electron beam irradiation in advance; a calculating means processing the image captured by the photographing means to decide the state of electron beam irradiation stored in the storage means. The storage means stores a first threshold value that is set at the maximum value of the emitted light luminance when the electron beam is irradiated normally; a second threshold value that is set at the minimum value of the emitted light luminance when the electron beam is irradiated normally, and is set at higher value than the emitted light luminance when the electron beam is irradiated with axis deviation; a third threshold value that is set at lower than the second threshold value, is set at higher value than the emitted light luminance when the electron beam is irradiated with broken filament, and is set to the minimum value of the emitted light luminance when the electron beam is irradiated with axis deviation; and at least three states of electron beam irradiation selected from a group consisting of normal, axis deviation, broken filament, and vacuum window deterioration are stored, and the each state corresponds to state areas of the storage means that are divided by the three threshold values. The calculating means loads the value of the emitted light luminance of the image captured by the photographing means to compare the loaded luminance value with each of the threshold values stored in the storage means, reads the state of electron beam irradiation stored in the storage means when the loaded luminance value is equal to or higher than the second threshold value and equal to or lower than the first threshold value, and decides that the state of electron beam irradiation is normal; reads the state of electron beam irradiation stored in the storage means when the loaded luminance value is lower than the second threshold value and equal to or higher than the third threshold value, and decides that the state of electron beam irradiation is axis deviation; and decides that the state of electron beam irradiation is broken filament among the states of electron beam irradiation stored in the storage means when the loaded luminance value is lower than the third threshold value. At least three states of electron beam irradiation stored in the storage means are decided by selecting optional three states of electron beam irradiation from the state representing group consisting of normal, axis deviation, broken filament, and vacuum window deterioration. Where at least the "vacuum window deterioration" is included in the selected three states of electron beam irradiation and when the emitted light luminance of the image captured is higher than the first threshold value, the calculating means reads in the state of electron beam irradiation stored in the storage means and decisions that the state of electron beam irradiation is being vacuum window deterioration.

The electron beam irradiating apparatus with monitoring device pertinent to claim 3 is the apparatus according to claim 2, in which the storage means stores a first threshold value that is set at the maximum value of the emitted light luminance when the electron beam is irradiated normally, and is set at lower value than the emitted light luminance when the electron beam is irradiated with the state of vacuum window deterioration, and the storage means also stores the states of electron beam irradiation each of which represents normal, axis deviation, broken filament, and vacuum window deterioration. The calculating means reads the state of electron beam irradiation stored in the storage means when the value of the emitted light luminance of the image captured by the photographing means is higher than the first threshold value and decides that the state of electron beam irradiation is vacuum window deterioration. The states of electron beam irradiation stored in the storage means are "normal", "axis deviation", "broken filament", and "vacuum window deterioration".

The electron beam irradiating apparatus with monitoring device pertinent to claim 4 is the apparatus according to claim 3, in which the electron beam irradiation means has a constant current controlled filament power supply and a voltmeter, the constant current controlled filament power supply being connected to a plurality of the filaments, the voltmeter measuring the filament voltage. The storage means stores a voltage setting that is higher than the filament voltage of the vacuum window deterioration and is equal to or lower than the filament voltage of the filament deterioration, and the storage means also stores the states of electron beam irradiation each of which represents normal, axis deviation, broken filament, vacuum window deterioration, and filament deterioration. The calculating means loads the filament voltage from the voltmeter when the value of the emitted light luminance of the image captured by the photographing means is higher than the first threshold value to compare with the voltage setting stored in the storage means and decides that the state of electron beam irradiation is the filament deterioration when the loaded filament voltage is equal to or higher than the voltage setting. The states of electron beam irradiation stored in the storage means are "normal", "axis deviation", "broken filament", and "vacuum window deterioration".

The electron beam irradiating apparatus with monitoring device pertinent to claim 5 is the apparatus according to claim 3, in which electron beam irradiation means has a constant voltage controlled filament power supply and an ammeter, the constant voltage controlled filament power supply being connected to a plurality of the filaments, the ammeter measuring the filament current. The storage means stores a voltage setting that is equal to or larger than the filament current of the filament deterioration and is smaller than the filament current of the axis deviation, and the storage means also stores the state of electron beam irradiation each of which represents normal, axis deviation, broken filament, vacuum window deterioration, and filament deterioration. The calculating means loads the filament current from the ammeter when the value of the emitted light luminance of the image captured by the photographing means is lower than the second threshold value and equal to or higher than the third threshold value to compare with the current setting stored in the storage means and decides that the state of electron beam irradiation is the filament deterioration when the loaded current is equal to or smaller than the current setting. The states of electron beam irradiation stored in the storage means are "normal", "axis deviation", "broken filament", and "vacuum window deterioration".

The electron beam irradiating apparatus with monitoring device pertinent to claim 6 is the apparatus according to claim 3, in which electron beam irradiation means has a constant current controlled filament power supply, a voltmeter, a grid, and a control means, the constant current controlled filament power supply being connected to a plurality of the filaments, the voltmeter measuring the filament voltage, the grid being connected to a grid power supply oppositely facing the filament, and the control means controlling the amount of thermal electrons emitted from the filament by regulating the voltage of the grid power supply. The storage means stores a voltage setting that is higher than the filament voltage of the normal and is equal to or lower than the filament voltage of the filament deterioration, and the storage means also stores the states of electron beam irradiation each of which represents normal, axis deviation, broken filament, vacuum window deterioration, and filament deterioration. The calculating means loads the filament voltage from the voltmeter when the value of the emitted light luminance of the image captured by the photographing means is equal to or higher than the second threshold value and equal to or lower than the first threshold value to compare with the voltage setting stored in the storage means and decides that the state of electron beam irradiation is being filament deterioration when the loaded voltage is equal to or higher than the voltage setting. The states of electron beam irradiation stored in the storage means are "normal", "axis deviation", "broken filament", and "vacuum window deterioration".

The electron beam irradiating apparatus with monitoring device pertinent to claim 7 is the apparatus according to claim 3, in which electron beam irradiation means has a constant voltage controlled filament power supply an ammeter, a grid, and a control means, the constant voltage controlled filament power supply being connected to a plurality of the filaments, the ammeter measuring the filament current, the grid being connected to a grid power supply oppositely facing the filament, the control means controlling the amount of thermal electrons emitted from the filament by regulating the voltage of the grid power supply; and a control means for controlling the amount of thermal electrons emitted from the filament by regulating the voltage of the grid power supply. The storage means stores a current setting that is equal to or larger than the filament current of the filament deterioration and smaller than the filament current of the normal, and the storage means also stores the states of electron beam irradiation each of which represents normal, axis deviation, broken filament, vacuum window deterioration, and filament deterioration. The calculating means loads the filament current from the ammeter when the value of the emitted light luminance of the image captured by the photographing means is higher than the first threshold value to compare with the current setting stored in the storage means and decides that the state of electron beam irradiation is filament deterioration when the loaded current is equal to or smaller than the current setting. The states of electron beam irradiation stored in the storage means are "normal", "axis deviation", "broken filament", and "vacuum window deterioration".

The electron beam irradiating apparatus with monitoring device pertinent to claim 8 is the apparatus according to claim 4 or claim 6, in which voltage setting stored in the storage means is set 1.1 times the initial filament voltage. Where setting the voltage setting encounters difficulty, setting at the value 1.1 times the initial filament voltage makes calculation of the voltage setting eased.

The electron beam irradiating apparatus with monitoring device pertinent to claim 9 is the apparatus according to claim 5 or claim 7, in which the current setting stored in the storage means is set 0.9 times the initial filament current. Where setting the current setting encounters difficulty, setting at the value 0.9 times the initial filament current makes calculation of the current setting eased.

The electron beam irradiating apparatus with monitoring device pertinent to claim 10 is the apparatus according to any one of claims 1 to 9, in which the calculating means divides the image captured by the photographing means into a plurality of segments and compares the emitted light luminance of the each segment with the threshold value stored in the storage means.

EFFECT OF INVENTION

According to the present invention, it is available to decide whether the state of electron beam irradiation in an electron beam irradiation apparatus is normal or abnormal, and further, in case of the state is abnormal, it is practicable to decide for at least two causes of the abnormality, thereby, more details of the causes can be identified. Thus, the identifying of the cause of abnormality in detail permits recognizing the abnormal section in an electron beam irradiation apparatus connecting to reduction of the operation outage time with the time required to perform a check operation shortened.

Further according to the present invention, it is not necessary to provide monitoring devices for each of the causes of the abnormality because at least two causes of the abnormality are decided on occurrence the abnormality; consequently thereby single monitoring device can decide plural causes of abnormality. Thus, the monitoring device can be simplified and providing an electron beam irradiation apparatus with a monitoring device having broad utility becomes realistic.

Still further according to the present invention, using the luminance of the image stored in the storage means in a form of threshold value permits comparing the emitted light luminance of the captured image with the threshold value to decide the state of electron beam irradiation for each of the state areas divided by the threshold values with the processing in the calculating means expedited.

BEST MODE FOR CARRYING OUT THE INVENTION

The following explains the electron beam irradiation apparatus with monitoring device by the present invention referring to drawings.

Embodiment 1

Figure 1:
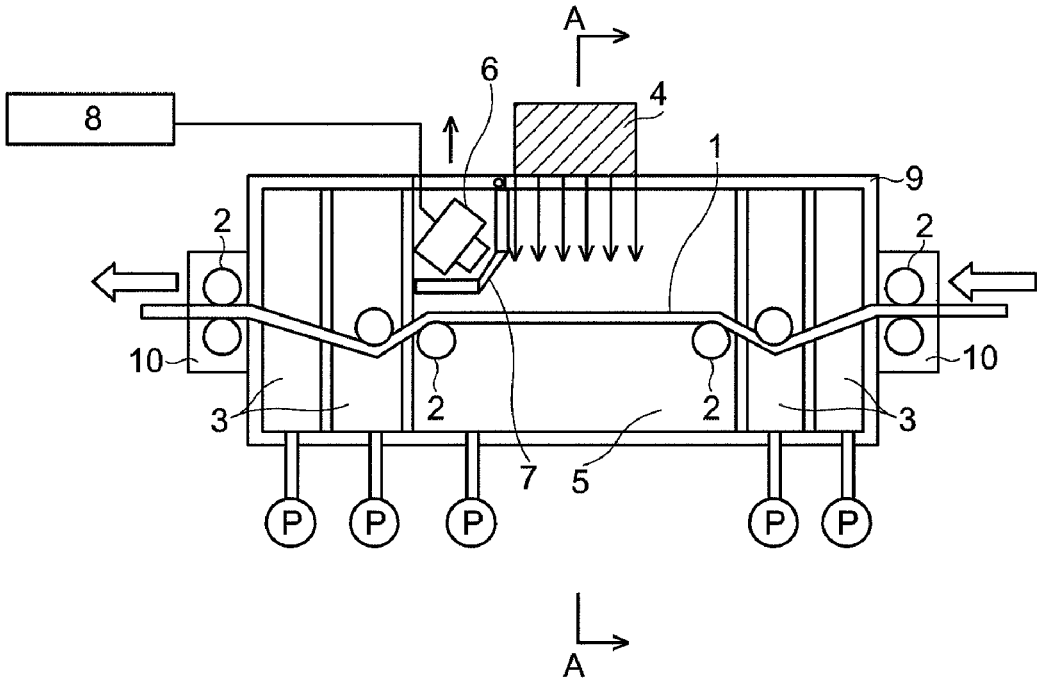
FIG. 1 is a schematic sectional side view of an electron beam irradiation apparatus with monitoring device to illustrate Embodiment 1 of the present invention.
Figure 2:
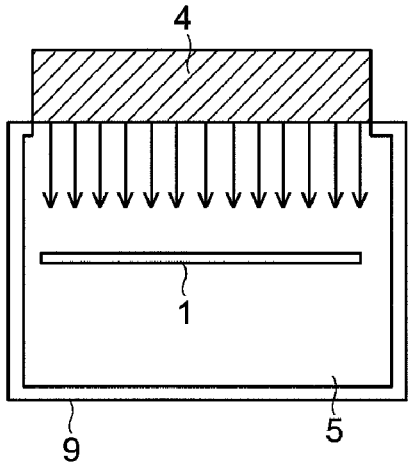
FIG. 2 is a vertical sectional view of the apparatus illustrated in FIG. 1 sectioned along the line A-A in FIG. 1.

FIG. 1 and FIG. 2 illustrate a part of the processing line that transfers continuously a series of materials, in which an electron beam irradiation means 4 is arranged above a carrier path 9 isolated from the outside and the materials on being transfer is irradiated with electron beam emitted from the electron beam irradiation means 4 for sterilization. FIG. 1 illustrates a plastic film 1 for food packing material as an explanatory example of the materials. The plastic film 1 is conveyed by rollers 2, which are provided to pinch the plastic film 1, from the right side to the left side in FIG. 1. The plastic film 1 being conveyed passes through the carrier path 9, having a hollow box-shape, of metal such as stainless steel to undergo sterilization. The carrier path 9 has the electron beam irradiation means 4 and has an irradiation chamber 5, where electron beam irradiates the plastic film 1, and decompression chambers 3 on front and on rear of the irradiation chamber 5. To the decompression chamber 3, an evacuation pump P is connected to keep the inside of the irradiation chamber 5 at a certain level of pressure-reduced state below the atmospheric pressure. This makes efficiency of the sterilization by the electron beam irradiation improved and permits use of an electron beam generation device that works on a low acceleration voltage. The rollers 2 provided on the carry-in and the carry-out sides are enveloped with a partition wall 10 so that the inside of the irradiation chamber 5 will maintain a reduced-pressure state.

On the carrier path 9, an observation window 7 is provided at the position when the irradiation state of the plastic film 1 can be observed. In the configuration illustrated in FIG. 1, the observation window 7 is secured on a metal structure of such as stainless steel and a space for accommodating a photographing means 6 is reserved inside the observation window 7. To permit accommodating the photographing means 6, the observation window 7 and the upper part of the space enveloped by the metal such as stainless steel are configured upwardly removable.

As the photographing means 6, a CCD camera having a luminance sensor is used. The CCD camera should preferably have a storage means and a calculating means for image processing. Where a CCD camera that has no storage means or calculating means is to be used, it is practicable to connect the camera to a personal computer (not illustrated) having a storage means and a calculating means. The CCD camera is connected to a display means 8 that displays the results decided by the calculating means. As the display means 8, the display device of a personal computer, an electric signboard, or a display unit of a control console of a controller of a power supply unit is applicable. It is preferable to provide an alarm-sounding function on the display means 8 to warn on displaying the cause of abnormality.

FIG. 2, the sectional view sectioned along the line A-A in FIG. 1, illustrates an aspect where the plastic film 1 is irradiated in the irradiation chamber 5 with electron beam emitted from the electron beam irradiation means 4. Except the area where the plastic film 1 travels, the inside of the hollow box-shaped carrier path 9 is a closed space forming a dark chamber. When electron beam irradiates the plastic film 1 in the irradiation chamber having such configuration, the irradiated surface thereof emits lights of which wavelength and intensity are dependent on the energy of electron beam radiated. By observing the luminance of the emitted lights with the photographing means 6, the state of electron beam irradiation is decided.

Figure 3:
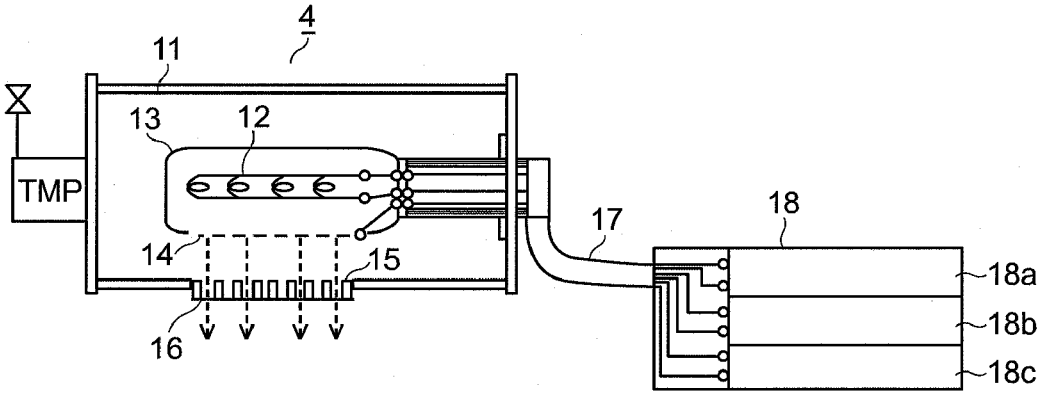
FIG. 3 is a schematic illustration of the electron beam irradiation means used in the electron beam irradiation apparatuses with monitoring devices described in Embodiments 1 to 8 of the present invention.

FIG. 3 is a detailed illustration of the electron beam irradiation means 4. The electron beam irradiation means 4 has a cathode 13 that emits electron beam and an anode 15 that accelerates electron beam emitted from the cathode 13 in vacuated area in an electron beam generating chamber 11, which is a highly vacuated chamber with a turbo-molecular pump TMP or other similar device for evacuation. The cathode 13 has a filament 12 that emits thermal electrons and a grid 14 that controls the thermal electrons emitted from the filament 12. The filament 12 is arranged in a manner, in which for example, 20 to 30 of filaments are arrayed in one row at a predetermined spacing and the arrayed filaments are configured into 5 sets of filament group each consisting of 5 filaments, and then the filaments in a group are connected in series. With this filament arrangement, even when only one filament is broken, the current does not flow to the remaining 4 filaments; consequently, no emission of thermal electron will occur from the group that has broken filament. Thus, no lights emission will be observed on a part of the plastic film 1 when no emission of thermal electrons is given. Therefore, the difference of the emitted light luminance can be easily identified.

The filament 12 is connected to a filament power supply 18*b* through a cable 17. The filament power supply 18*b* makes the filament 12 heat to allow the thermal electron emission. Between the filament 12 and the grid 14, a grid power supply 18*c* is connected through the cable 17 to apply a voltage therebetween for controlling the thermal electron emission. Between the grid 14 and a vacuum window 16, a high-voltage direct current power supply 18*a* is connected through the cable 17 to apply the acceleration voltage. The filament 12 heats with the alternating current fed from the filament power supply 18*b* to emit thermal electron, among which only those passed the grid 14 are taken out as the usably emitted electron beam. The electron beam thus emitted is accelerated by the acceleration voltage applied by a high-voltage direct current power supply and penetrates the vacuum window 16 to irradiate the materials.

Figure 4:
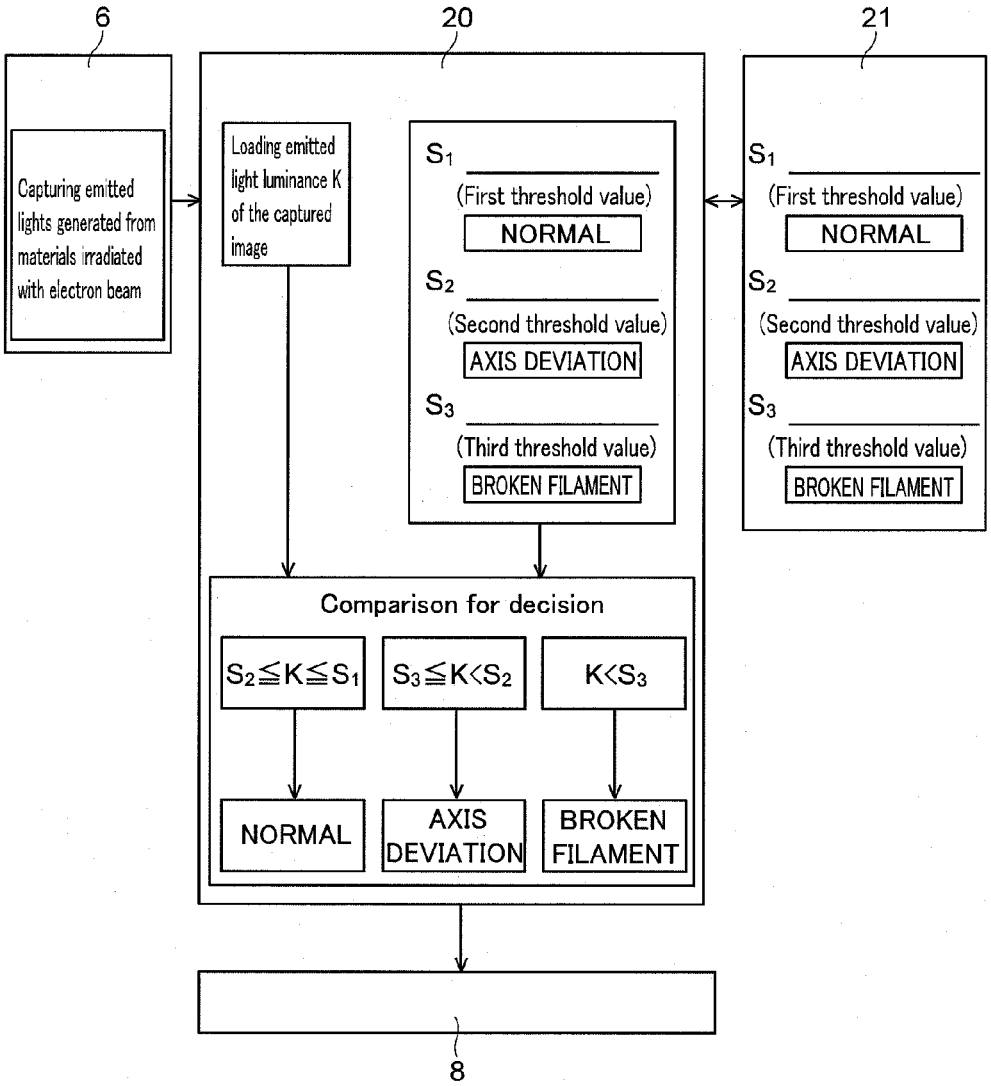
FIG. 4 is a block diagram to describe the monitoring device used in the electron beam irradiation apparatus with monitoring device in Embodiment 1 of the present invention.

FIG. 4, which illustrates an example in which the threshold value is used as the value for representing the luminance of image stored in a storage means 21, indicates the flow of processing steps from image capturing by the photographing means 6 to deciding the state of electron beam irradiation in a block diagram style. FIG. 4 explains an example in which at least three states of electron beam irradiation: "normal", "axis deviation", and "broken filament", are selected. The decision of the state of electron beam irradiation may be performed by storing in advance in the storage means 21 the luminance data of images corresponding to at least three states of electron beam irradiation as the luminance of the image to be stored in the storage means in addition to the threshold values followed by comparison of the image captured by the photographing means 6 with the luminance data of images stored in the storage means 21. This processing manner requires that a lot of luminance data of images must be stored in the storage means 21. Therefore, use of threshold values is preferable from the viewpoint of the processing speed of a calculating means 20.

The photographing means 6 captures the emitted lights produced by the irradiating of the materials and stores temporarily the captured image in a memory (not shown) provided in the photographing means 6. The image stored in the memory is transferred to the calculating means 20 to be taken therein as an emitted light luminance K. The calculating means 20, taking in the emitted light luminance K, reads in predetermined threshold values S1, S2, and S3 stored in advance in the storage means 21. The calculating means 20 compares the threshold values S1, S2, and S3 thus read in with the emitted light luminance K to decide to which state among at least three states of electron beam irradiation stored in the storage means 21 the irradiation state belongs, based on the judgment into which state area divided by the threshold values S1, S2, and S3 the emitted light luminance K falls.

The threshold value S1, a first threshold value, is set at the maximum of the emitted light luminance when the electron beam is irradiated normally. This maximum is the highest value among the emitted light luminance recorded in advance for a certain period of time during the electron beam is irradiated normally.

The threshold value S2, a second threshold value, is set at such a value as is the minimum of the emitted light luminance when the electron beam is irradiated normally but higher than the emitted light luminance which the electron beam irradiating with axis deviation. Similarly, this minimum is the lowest value among the emitted light luminance recorded for a certain period of time during the electron beam ion is irradiated normally. The value higher than the emitted light luminance which the electron beam irradiating with axis deviation is such a value as is slightly higher than the highest value among the emitted light luminance recorded for a certain period of time during the electron beam irradiation is working with axis deviation. It is preferable that this minimum accords with the value that the axis deviation. However if not, it is preferable to give the priority to the recorded minimum.

The threshold value S3, a third threshold value, is set at such a value as is lower than the second threshold value S2 but higher than the emitted light luminance which the electron beam irradiating with broken filament and is equal to the minimum of the emitted light luminance which the electron beam irradiating with axis deviation. The luminance higher than the emitted light luminance which the electron beam irradiating with broken filament is such a value as is slightly higher than the highest value among the emitted light luminance recorded in advance for a certain period of time during the electron beam irradiation is working with a condition in which one filament among plural filaments is broken. The minimum of the emitted light luminance which the electron beam irradiation working with axis deviation is such a value as is the lowest value among the emitted light luminance recorded in advance for a certain period of time during the electron beam irradiation is working with axis deviation. It is preferable that the value in the case of the broken filament accords with the value that the axis deviation. However if not, it is referable to give the priority to the value with the broken filament.

The state of electron beam irradiation is defined in state categories: "normal" when the electron beam is irradiated normally; "axis deviation" when the electron beam is irradiated abnormally with axis deviation; and "broken filament". "Normal" means a state in which the electron beam is irradiating the materials uniformly with specified dose. "Axis deviation" means a state in which the holes on the anode 15 and the grid 14, which are illustrated in FIG. 3, are not in alignment. If the electron beam is irradiated under this deviated condition, thermal electrons do not smoothly pass through the vacuum window 16 resulting in insufficient irradiation over the materials developing possibly into the cause of the irradiation omission. "Broken filament" means a state in which at least one filament among plural filaments 12 is broken causing no current flow. If the electron beam is irradiated under this condition, no irradiation will be applied to the materials on the portion thereof that faces the broken filament developing into the irradiation omission.

The state of electron beam irradiation as a result of decision by the calculating means 20 is transferred to the display means 8 to permit outputting.

Figure 5:
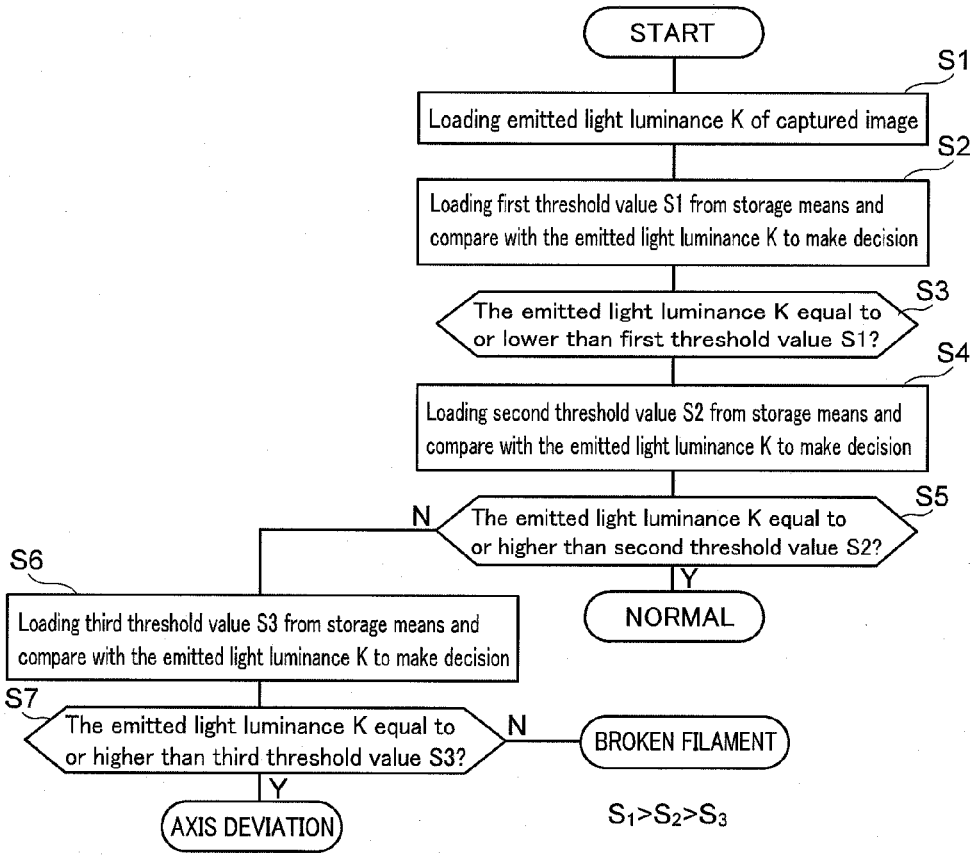
FIG. 5 is a flowchart to describe details of the processing in the calculating means indicated in FIG. 4.

FIG. 5 is a flowchart indicating details of the processing steps in the calculating means 20. The calculating means 20 first loads the emitted light luminance K from the image captured by the photographing means 6 (S1). After acquiring the emitted light luminance K, the calculating means 20 further loads the first threshold value S1 stored in advance in the storage means 21 to compare with the emitted light luminance K of the image captured (S2). In the comparison, it is compared whether or not the emitted light luminance K is equal to or lower than the first threshold value S1 (S3). When the emitted light luminance K is equal to or lower than the first threshold value S1, the calculating means 20 successively loads the second threshold value S2 from the storage means 21 to compare the second threshold value S2 with the emitted light luminance K (S4). In the comparison, it is compared whether or not the emitted light luminance K is equal to or higher than the second threshold value S2 (S5). When, in contrast, the emitted light luminance K is higher than the first threshold value S1, the calculating means 20 ends further decision and ceases processing. In this case, the state may be decided abnormal because the emitted light luminance K is higher than the first threshold value S1 that is the maximum of the emitted light luminance when the electron beam is irradiated normally. When "vacuum window deterioration" is included in the group of at least three states of electron beam irradiation, the state should be decided to be the vacuum window deterioration if the emitted light luminance K is higher than the first threshold value S1. When the emitted light luminance K is equal to or higher than the second threshold value S2 in the processing under S5, the calculating means 20 reads in "normal" from among at least three states of electron beam irradiation stored in advance in the storage means and decides that the state of electron beam irradiation is normal. When, in contrast, the emitted light luminance K is lower than the second threshold value S2, the calculating means 20 loads the third threshold value S3 from the storage means 21 to compare the third threshold value S3 with the emitted light luminance K (S6). In the comparison, it is compared whether or not the emitted light luminance K is equal to or higher than the third threshold value S3 (S7). When the emitted light luminance K is equal to or higher than the third threshold value S3, the calculating means 20 reads in "axis deviation" from among at least three states of electron beam irradiation stored in advance in the storage means 21 and decides that the state of electron beam irradiation is being axis deviation. When, in contrast, the emitted light luminance K is lower than the third threshold value S3, the calculating means 20 reads in "broken filament" from among at least three states of electron beam irradiation stored in advance in the storage means 21 and decides that the state of electron beam irradiation is being broken filament.

Embodiment 2

Embodiment 2 is an example in which the vacuum window deterioration is added to the states of electron beam irradiation described in Embodiment 1. Explanation follows referring to the block diagram indicated in FIG. 6. The elements same as those in FIG. 4 are assigned the same signs used in FIG. 4 and explanation is omitted for those portions that have appeared in FIG. 4.

In Embodiment 2, a first threshold value stored in the storage means 21 is set, to permit decision of vacuum window deterioration, at such a value as is the maximum of the emitted light luminance when the electron beam is irradiated normally but lower than the emitted light luminance which appears when the vacuum window is deteriorated. This value, which is lower than the emitted light luminance which appears when the vacuum window is deteriorated, is set at such a value as is lower than the lowest value among the emitted light luminance recorded for a certain period of time during the electron beam irradiating with vacuum window being deteriorated. It is preferable that this value accords with the maximum of the emitted light luminance under the normal state. However if not, it is preferable to give the priority to the maximum of the emitted light luminance under the normal state. In the storage means 21, the fourth state of electron beam irradiation, vacuum window deterioration, is stored. "Vacuum window deterioration" is a state in which the electron beam irradiation means 4 emits electron beam in an amount beyond necessity because of the reduction in thickness of the vacuum window made of such as graphite due to long-year use. In this event, an excessive amount of electron beam is irradiated to the materials possibly developing into deterioration of the object or generation of ozone with smell. Further, the excessive irradiation of electron beam makes the emitted light luminance intensive more than in the normal irradiation. Thus, Embodiment 2 decides the vacuum window deterioration capturing such intensive luminance.

In the decision of the vacuum window deterioration, the calculating means 20 loads the emitted light luminance K of the image captured by the photographing means 6 to compare with the first threshold value S1. When the emitted light luminance K is higher than the first threshold value S1, the calculating means 20 reads in the state of electron beam irradiation of vacuum window deterioration stored in the storage means 21 to decide that the state of electron beam irradiation is being vacuum window deterioration. Then, the result of the decision is transferred to the display means 8 to permit outputting.

Figure 7:
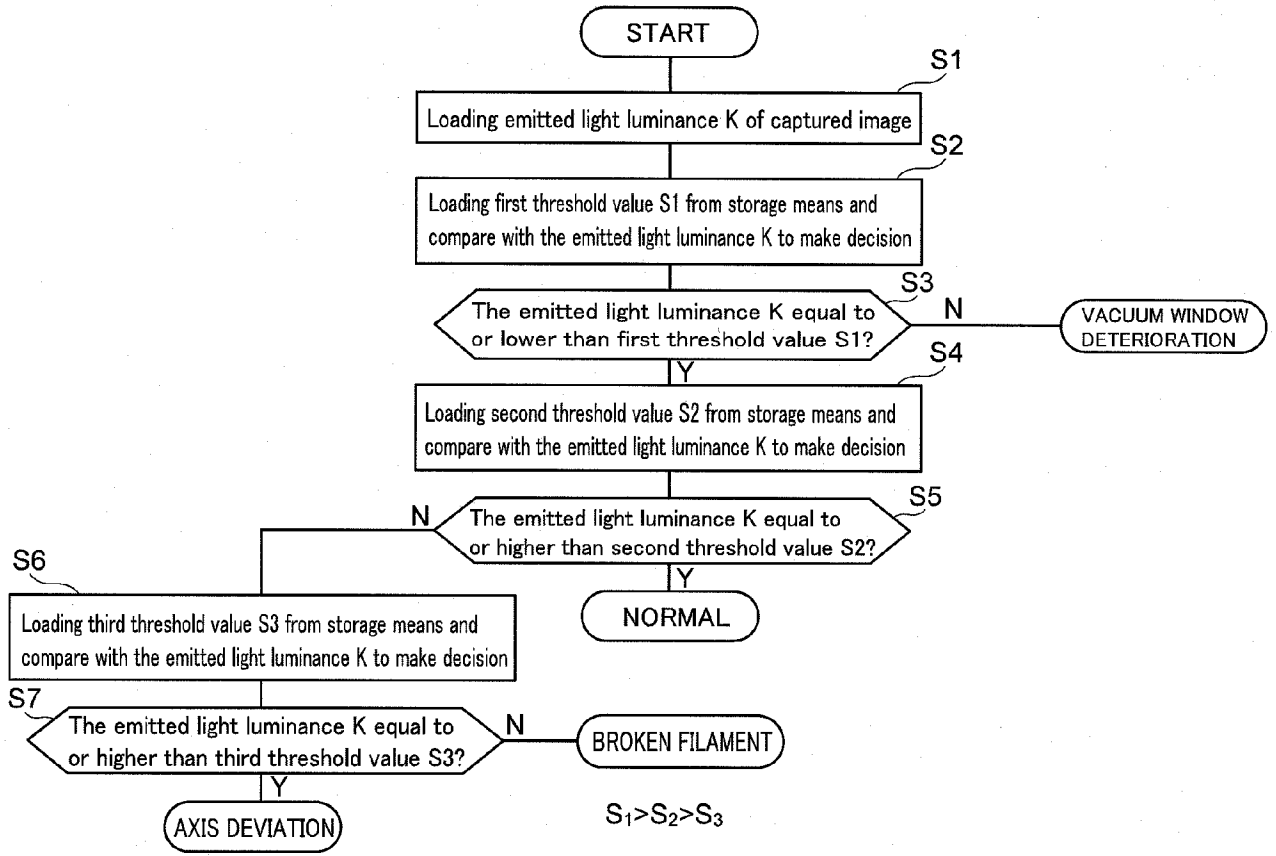
FIG. 7 is a flowchart to describe details of the processing in the calculating means indicated in FIG. 6.

Explanation follows referring to FIG. 7, a flowchart indicating details of processing steps in the calculating means 20. The elements same as those in FIG. 5 are assigned the same signs used in FIG. 5 and explanation is omitted for those portions that have appeared in FIG. 5.

As indicated in FIG. 7, when the process S3 finds the emitted light luminance K is higher than the first threshold value S1, the calculating means 20 reads in "vacuum window deterioration" from among states of electron beam irradiation stored in advance in the storage means 21 to decide that the state of electron beam irradiation is being vacuum window deterioration. Other processing is the same as those described in the explanation of Embodiment 1.

Embodiment 3

Figure 6:
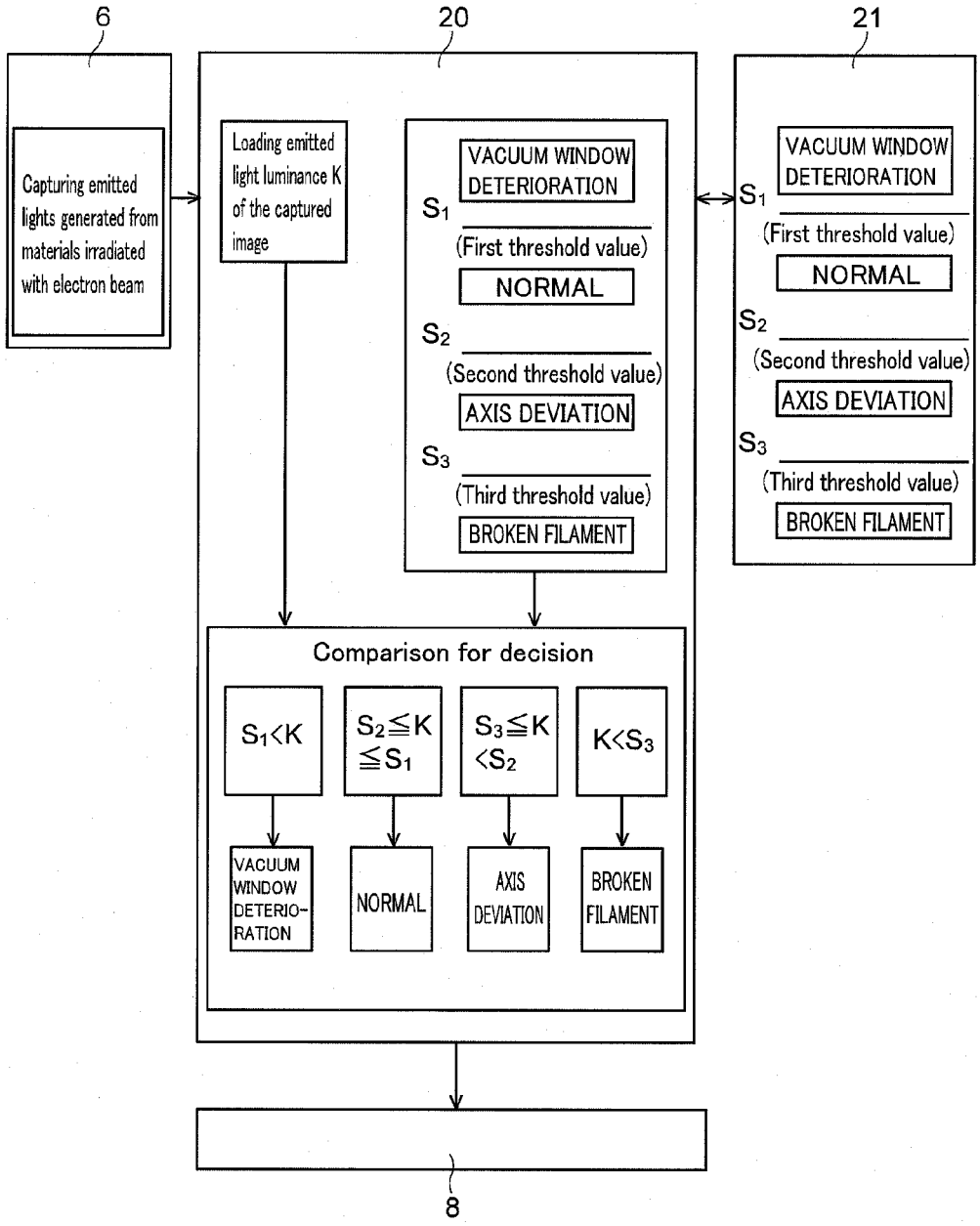
FIG. 6 is a block diagram to describe the monitoring device used in the electron beam irradiation apparatus with monitoring device in Embodiment 2 of the present invention.

Embodiment 3 is an example in which the filament power supply 18*b* uses a constant current controlled filament power supply, in which the filament deterioration is added to the states of electron beam irradiation described in Embodiment 2. Explanation follows referring to the block diagram indicated in FIG. 8. The elements same as those in FIG. 4 or FIG. 6 are assigned the same signs used in such figures and explanation is omitted for those portions that have appeared in FIG. 4 or FIG. 6.

Figure 8:
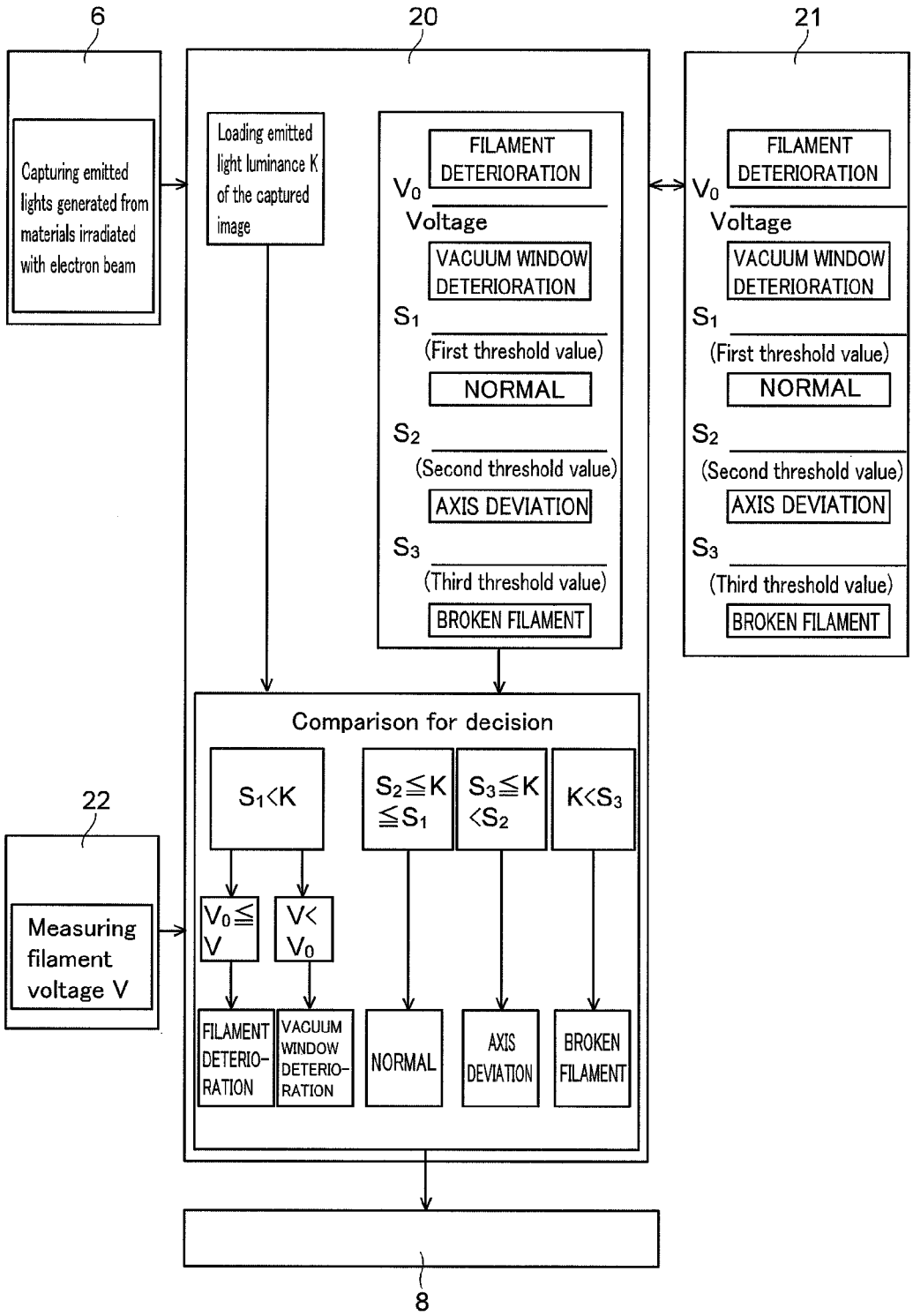
FIG. 8 is a block diagram to describe the monitoring device used in the electron beam irradiation apparatus with monitoring device in Embodiment 3 of the present invention.

As indicated in FIG. 8, the storage means 21 stores a voltage setting V0 and the fifth state of electron beam irradiation, filament deterioration, is stored. The voltage setting V0 is set at such a value as is higher than the filament voltage that causes the vacuum window deterioration but is equal to or lower than the filament voltage that causes the filament deterioration. In setting the voltage setting V0, it is preferable to make the filament voltages in the vacuum window deterioration and in the filament deterioration grasped. It is feasible to set the voltage setting V0 at a value 1.1 times the initial voltage of the filament. The "filament deterioration" is a state in which the resistance of the filament is increased because of the reduction in filament thickness due to long-year use. In this embodiment, a constant current controlled filament is used; therefore, the filament current is kept always constant even though the filament resistance increases. Consequently, the filament voltage increases corresponding to increase in the resistance. As a result of this, if the electron beam is irradiated with the filament deteriorated, the filament voltage increases causing such a state that an excessive amount of electron beam is irradiated to the materials possibly developing into deterioration of the object or generation of ozone with smell. In view of this problem, a voltmeter 22 is installed between the filament and the filament power supply to decide these modes of filament deterioration. The voltmeter 22 measures a filament voltage V of the filament. It is preferable to arrange the voltmeter 22 so that total of the filament voltages V across plural filaments will be measured. Where the voltmeter 22 measures the total of the filament voltages V across plural filaments, the voltage setting V0 to be stored in the storage means 21 is set at a value decided considering the total value over plural filaments. The filament voltage V measured with the voltmeter 22 is taken into the calculating means 20 when the measurement is as specified.

In the decision of the filament deterioration, the calculating means 20 loads the emitted light luminance K of the image captured by the photographing means 6 to compare with the first threshold value S1. When the emitted light luminance K is higher than the first threshold value S1, the calculating means 20 loads the filament voltage V from the voltmeter 22 to compare the loaded filament voltage V with the voltage setting V0 stored in the storage means 21. When the comparison indicates that the filament voltage V is lower than the voltage setting V0, the calculating means 20 reads in the state of the vacuum window deterioration stored in the storage means 21 to decide that the state of electron beam irradiation is being vacuum window deterioration. When, in contrast, the filament voltage V is equal to or higher than the voltage setting V0, the calculating means 20 reads in the state of filament deterioration stored in the storage means 21 to decide that the state of electron beam irradiation is being filament deterioration. Then, the result of the decision is transferred to the display means 8 to permit outputting.

Figure 9:
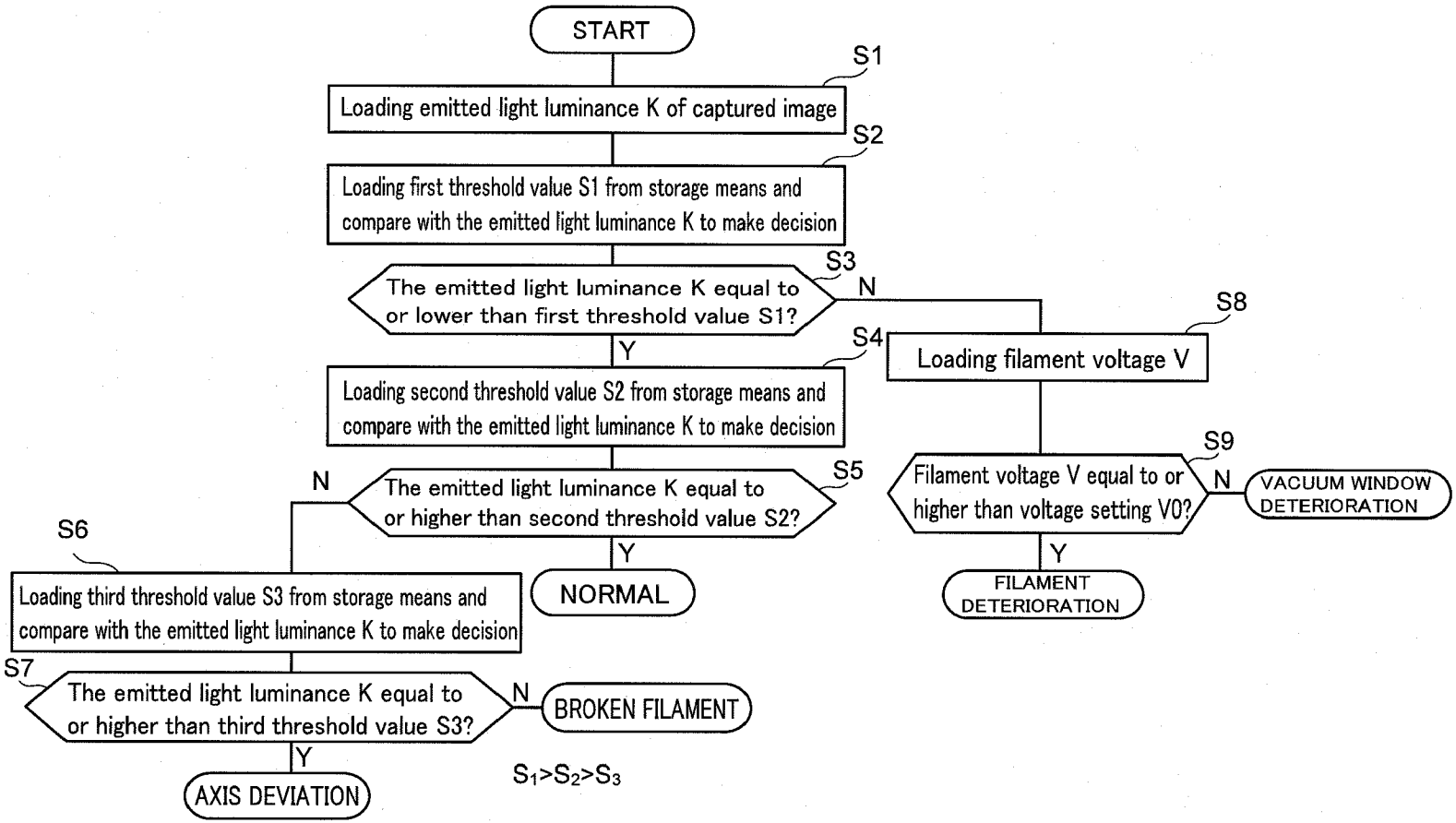
FIG. 9 is a flowchart to describe details of the processing in the calculating means indicated in FIG. 8.

Explanation follows referring to FIG. 9, a flowchart indicating details of processing steps in the calculating means 20. The elements same as those in FIG. 5 or FIG. 7 are assigned the same signs used in such figures and explanation is omitted for those portions that have appeared in FIG. 5 or FIG. 7.

When the calculating means 20 finds in the processing step S3 that the emitted light luminance K is not equal to nor lower than the first threshold value S1, the calculating means 20 loads the filament voltage V from the voltmeter 22 (S8). Then, the calculating means 20 decides whether or not the loaded filament voltage V is equal to or higher than the voltage setting V0 stored in the storage means 21 (S9). When the filament voltage V is equal to or higher than the voltage setting V0, the calculating means 20 reads in the state of "filament deterioration" from among states of electron beam irradiation stored in advance in the storage means 21 to decide that the state of electron beam irradiation is being filament deterioration. When, in contrast, the filament voltage V is not equal to nor higher than the voltage setting V0, the calculating means 20 reads in "vacuum window deterioration" from among the states of filament deterioration stored in advance in the storage means 21 to decide that the state of electron beam irradiation is being vacuum window deterioration.

Embodiment 4

Figure 10:
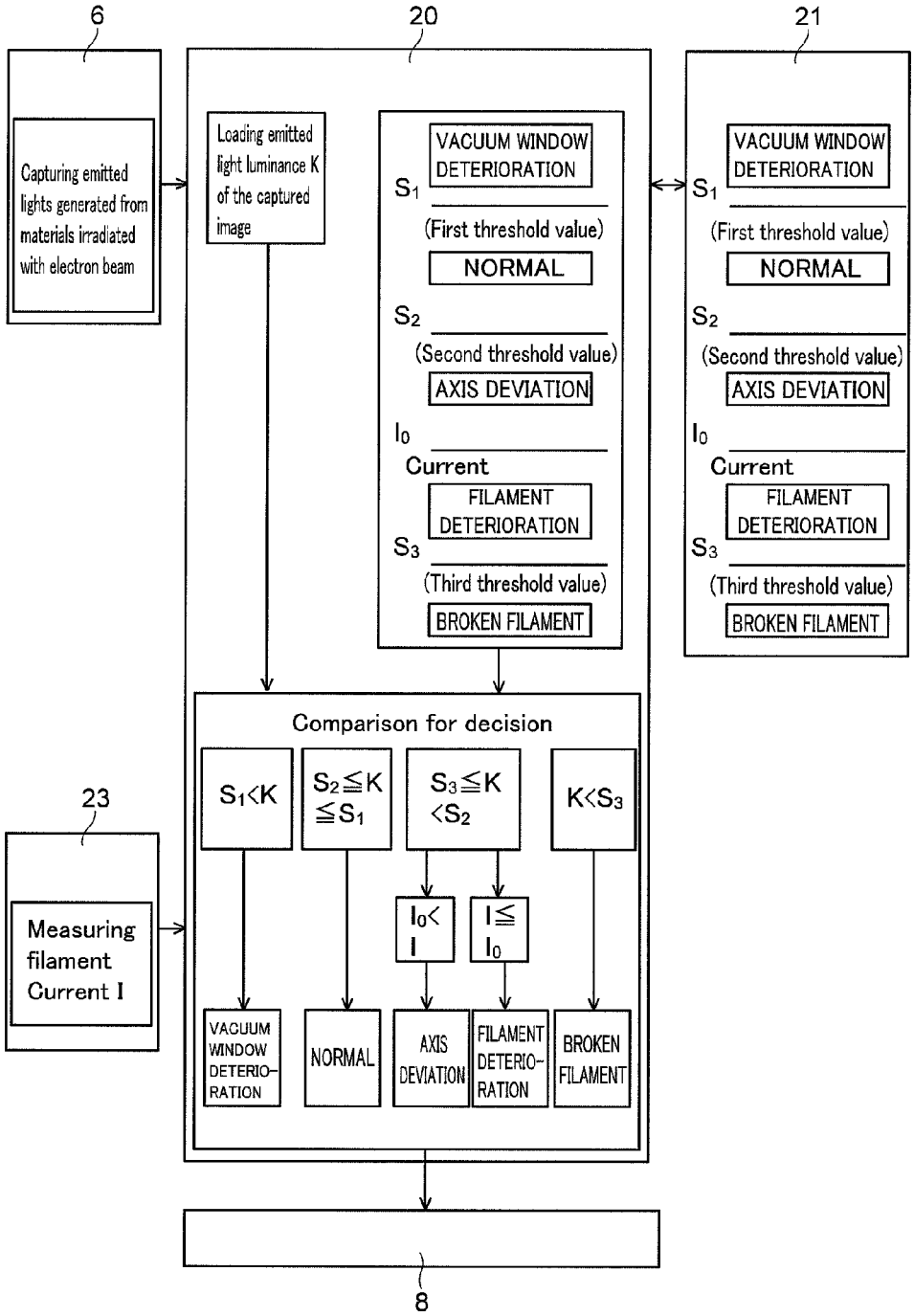
FIG. 10 is a block diagram to describe the monitoring device used in the electron beam irradiation apparatus with monitoring device in Embodiment 4 of the present invention.

Embodiment 4 is an example in which the filament power supply 18*b* uses a constant voltage controlled filament power supply, in which the filament deterioration is added to the states of electron beam irradiation similarly to the addition in Embodiment 3. Explanation follows referring to the block diagram indicated in FIG. 10. The elements same as those in FIG. 4, 6 or 8 are assigned the same signs used in such figures and explanation is omitted for those portions that have appeared in FIG. 4, 6, or 8.

As indicated in FIG. 8, the storage means 21 stores a current setting I0 and the fifth state of electron beam irradiation, filament deterioration, is stored. The current setting I0 is set at such a value as is equal to or larger than the filament current that causes the filament deterioration but smaller than the filament current that causes the filament deterioration. In setting the current setting I0, it is preferable to make the filament currents in the filament deterioration and in the axis deviation grasped. It is feasible to set the current setting I0 at a value 0.9 times the initial current of the filament.

In this embodiment, a constant voltage controlled filament power supply is used; therefore, the filament voltage is kept always constant even though the filament resistance increases due to long-year use deterioration. Consequently, the filament current decreases corresponding to increase in the resistance. As a result of this, the amount of thermal electrons is decreased. Accordingly, if the electron beam is irradiated with the filament being deteriorated, the materials will not be irradiated sufficiently developing possibly into the cause of the irradiation omission. Further, the emitted light luminance reduces compared to the luminance in "normal" state since the materials is not irradiated with sufficient amount of electron beam.

An ammeter 23 is installed between the filament and the filament power supply. The ammeter 23 measures a filament current I of the filament. Since the filament is used in plurality, it is preferable to arrange the ammeter 23 so that total of the filament currents I flow through plural filaments will be measured. In this arrangement, the current setting I0 to be stored in the storage means 21 is set at a value decided considering the total value over plural filaments. The filament current I measured with the ammeter 23 is taken into the calculating means 20 when the measurement is as specified.

In the decision of the filament deterioration, the calculating means 20 loads the emitted light luminance K of the image captured by the photographing means 6 to compare with the second threshold value S2. When the emitted light luminance K is equal to or higher than the third threshold value S3 and lower than the second threshold value S2, the calculating means 20 loads the filament current I from the ammeter 23 to compare the loaded filament current I with the current setting I0 stored in the storage means 21. When the comparison indicates that the filament current I is equal to or smaller than the current setting I0, the calculating means 20 reads in the state of the filament deterioration stored in the storage means 21 to decide that the state of electron beam irradiation is being filament deterioration. When, in contrast, the filament current I is equal to or larger than the current setting I0, the calculating means 20 reads in the state of axis deviation stored in the storage means 21 to decide that the state of electron beam irradiation is being axis deviation. Then, the result of the decision is transferred to the display means 8 to permit outputting.

Figure 11:
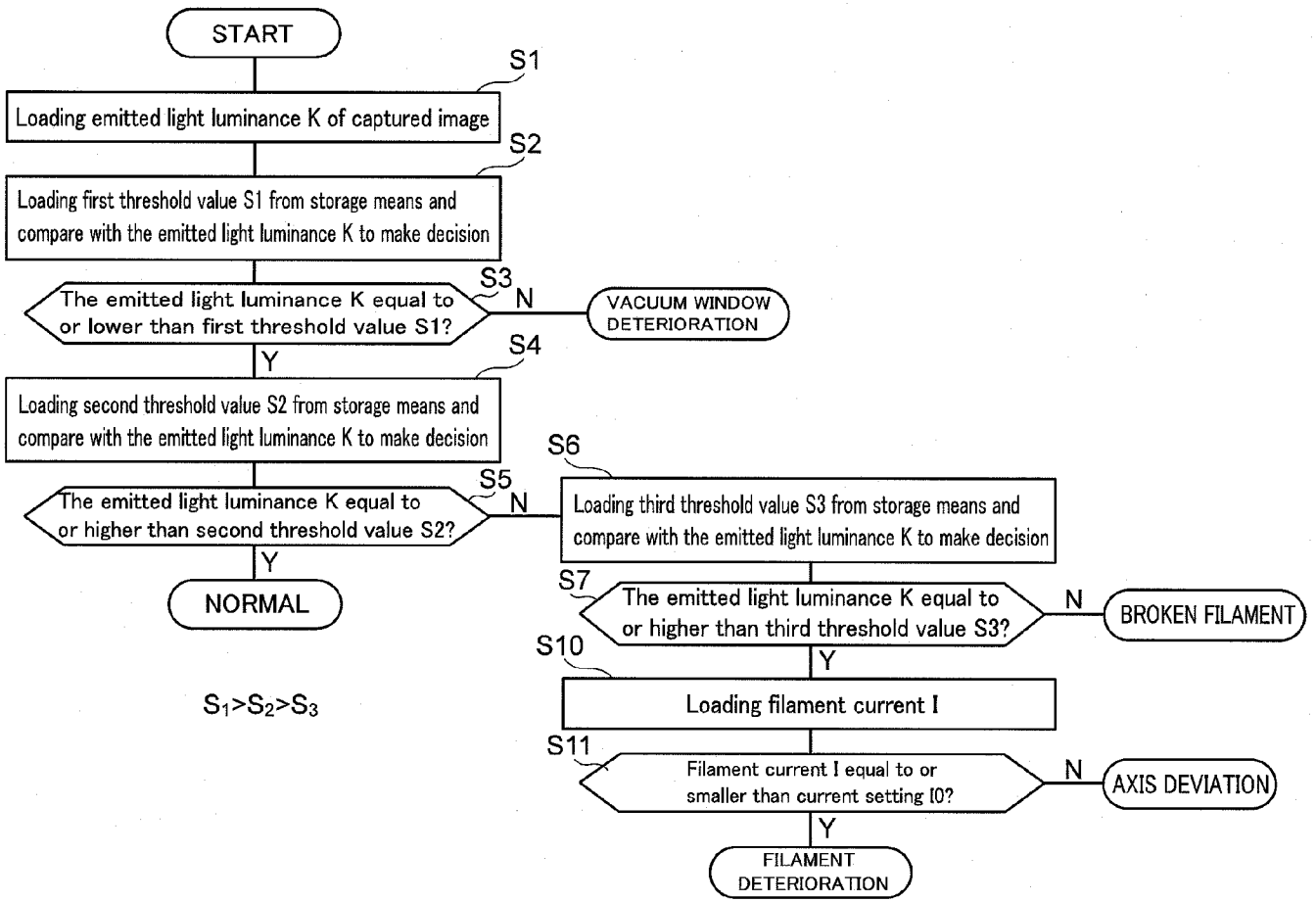
FIG. 11 is a flowchart to describe details of the processing in the calculating means indicated in FIG. 10.

Explanation follows referring to FIG. 11, a flowchart indicating details of processing steps in the calculating means 20. The elements same as those in FIG. 5, 7, or 9 are assigned the same signs used in such figures and explanation is omitted for those portions that have appeared in FIG. 5, 7, or 9.

When the calculating means 20 finds in the processing step S7 that the emitted light luminance K is equal to or higher than the third threshold value S3, the calculating means 20 loads the filament current I from the ammeter 23 (S10). Then, the calculating means 20 decides whether or not the loaded filament current I is equal to or smaller than the current setting I0 stored in the storage means 21 (S11). When the filament current I is equal to or smaller than the current setting I0, the calculating means 20 reads in the state of "filament deterioration" from among states of electron beam irradiation stored in advance in the storage means 21 to decide that the state of electron beam irradiation is being filament deterioration. When, in contrast, the filament current I is not equal to nor smaller than the current setting I0, the calculating means 20 reads in "axis deviation" from among the states of filament deterioration stored in advance in the storage means 21 to decide that the state of electron beam irradiation is being axis deviation.

Embodiment 5

Embodiment 5 is an example in which a feedback control means (not shown) is provided additionally to the configuration described in Embodiment 3 to control the amount of thermal electrons that the filament emits to be constant by regulating the grid voltage. With this control means, electron beam irradiation can continue its performance within a normal state by the regulating of the grid voltage even when the amount of emission of the thermal electrons is in excess of the normal amount range. Explanation of an example that uses this control means follows referring to the block diagram indicated in FIG. 12. The elements same as those in FIG. 4, 6, 8, or 10 are assigned the same signs used in such figures and explanation is omitted for those portions that have appeared in these figures.

Figure 12:
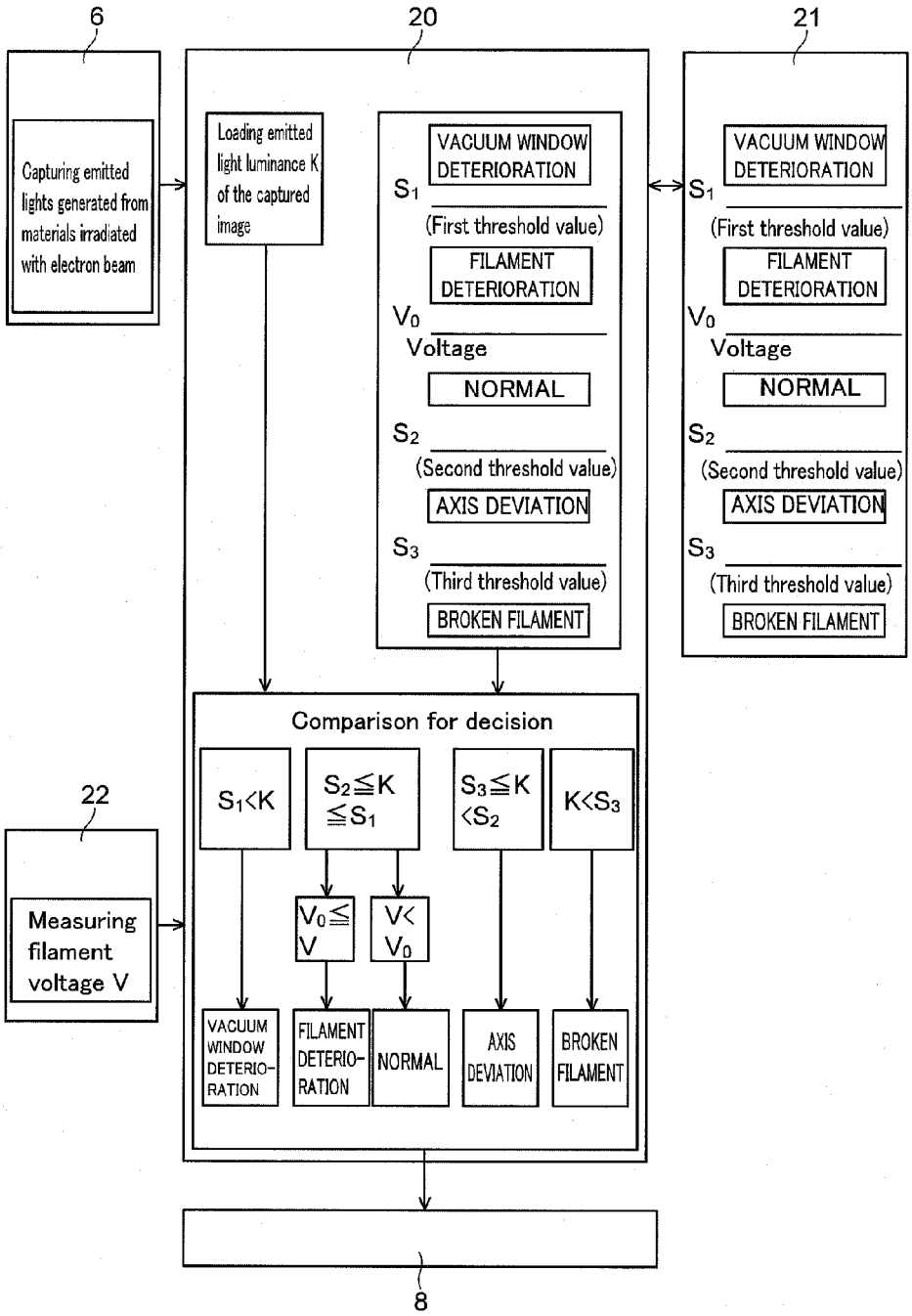
FIG. 12 is a block diagram to describe the monitoring device used in the electron beam irradiation apparatus with monitoring device in Embodiment 5 of the present invention.

As indicated in FIG. 12, the storage means 21 stores the state of filament deterioration and the voltage setting V0. The voltage setting V0 is set at such a value as is higher than the filament voltage that appears when the electron beam is irradiated normally but equal to or lower than the filament voltage that causes the filament deterioration. In setting the voltage setting V0, it is preferable to make the filament voltages under the normal state and in the filament deterioration grasped. It is feasible to set the voltage setting V0 at a value 1.1 times the initial voltage of the filament.

In this embodiment, the constant current controlled filament power supply is used similarly to Embodiment 3. Therefore, an excessive electron beam irradiation occurs when the filament deteriorates due to long-year use since the deterioration causes the increased resistance of the filament and consequently invites increase in the filament voltage. Further, this embodiment employs a control means; therefore, the electron beam irradiation same as being under the normal state can be maintained by regulating the grid voltage with the control means even when the filament deterioration occurs more or less. When the filament deterioration develops into a degree that the control means cannot control, the calculating means 20 decides that the state is being filament deterioration based on the result of comparison with the voltage setting V0.

In the decision of the filament deterioration, the calculating means 20 loads the emitted light luminance K of the image captured by the photographing means 6 to compare with the first threshold value S1 and the second threshold value S2. When the emitted light luminance K is equal to or higher than the second threshold value S2 and equal to or lower the first threshold value S1, the calculating means 20 loads the filament voltage V from the voltmeter 22 to compare the loaded filament voltage V with the voltage setting V0 stored in the storage means 21. When the comparison indicates that the filament voltage V is equal to or higher than the voltage setting V0, the calculating means 20 reads in the state of the filament deterioration stored in the storage means 21 to decide that the state of electron beam irradiation is being filament deterioration. When, in contrast, the filament voltage V is lower than the voltage setting V0, the calculating means 20 reads in the state of normal stored in the storage means 21 to decide that the state of electron beam irradiation is normal. Then, the result of the decision is transferred to the display means 8 to permit outputting.

Figure 13:
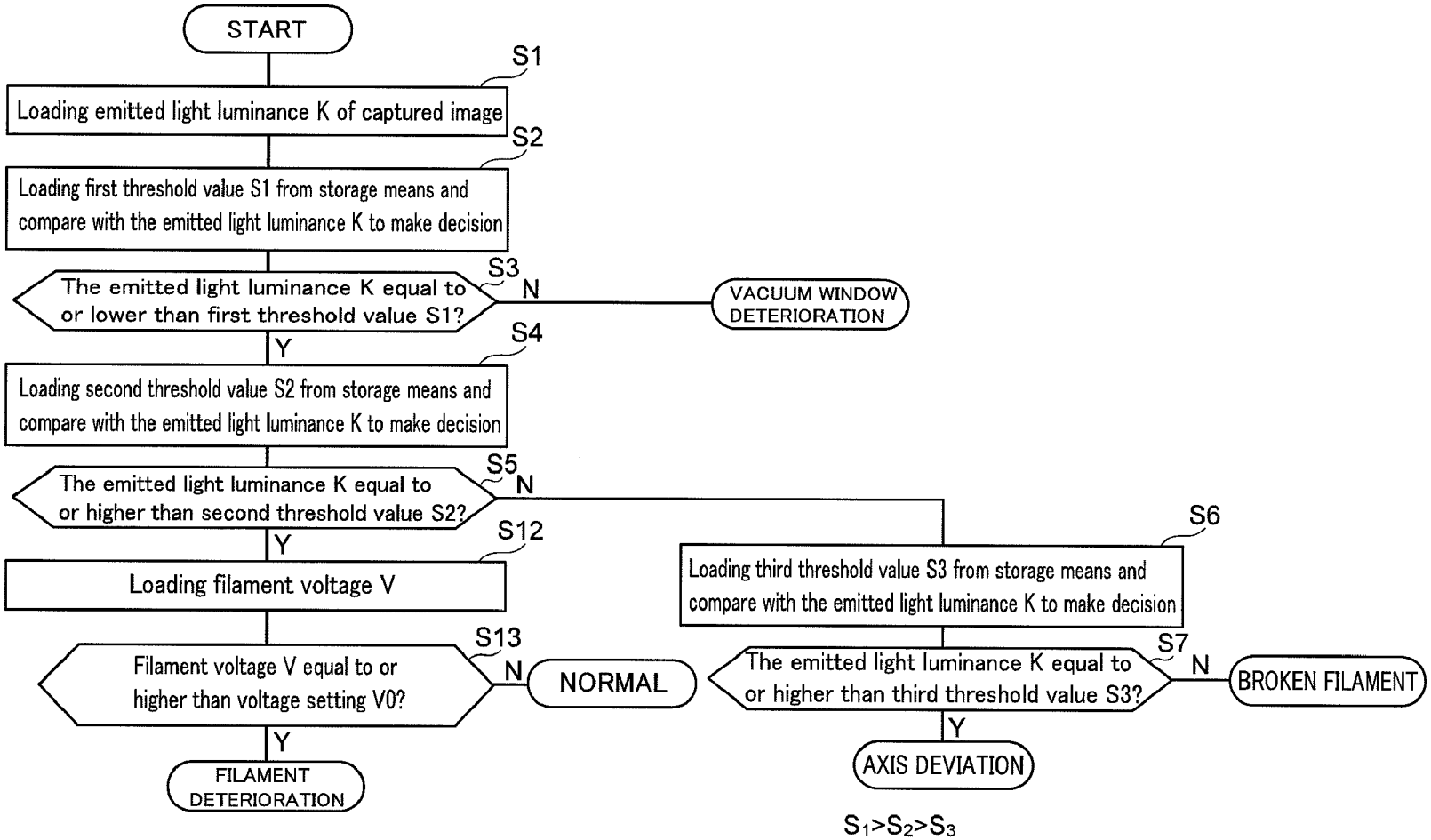
FIG. 13 is a flowchart to describe details of the processing in the calculating means indicated in FIG. 12.

Explanation follows referring to FIG. 13, a flowchart indicating details of processing steps in the calculating means 20. The elements same as those in FIG. 5, 7, 9, or 11 are assigned the same signs used in such figures and explanation is omitted for those portions that have appeared in these figures.

When the calculating means 20 finds in the processing step S5 that the emitted light luminance K is equal to or higher than the second threshold value S2, the calculating means 20 loads the filament voltage V from the voltmeter 22 (S12). Then, the calculating means 20 decides whether or not the loaded filament voltage V is equal to or higher than the voltage setting V0 stored in the storage means 21 (S13). When the filament voltage V is equal to or higher than the voltage setting V0, the calculating means 20 reads in the state of "filament deterioration" from among states of electron beam irradiation stored in advance in the storage means 21 to decide that the state of electron beam irradiation is being filament deterioration. When, in contrast, the filament voltage V is not equal to nor higher than the voltage setting V0, the calculating means 20 reads in "normal" from among the states of filament deterioration stored in advance in the storage means 21 to decide that the state of electron beam irradiation is normal.

Embodiment 6

Embodiment 6 is an example in which a feedback control means (not shown) similar to that in Embodiment 5 is provided additionally to the configuration described in Embodiment 4 to control the amount of thermal electrons that the filament emits to be constant by regulating the grid voltage. With this control means, electron beam irradiation can continue its performance within a normal state by the regulating of the grid voltage even when the amount of emission of the thermal electrons is in excess of the normal amount range. Explanation of an example that uses the constant voltage controlled filament power supply and this control means follows referring to the block diagram indicated in FIG. 14. The elements same as those in FIG. 4, 6, 8, 10, or 12 are assigned the same signs used in such figures and explanation is omitted for those portions that have appeared in these figures.

Figure 14:
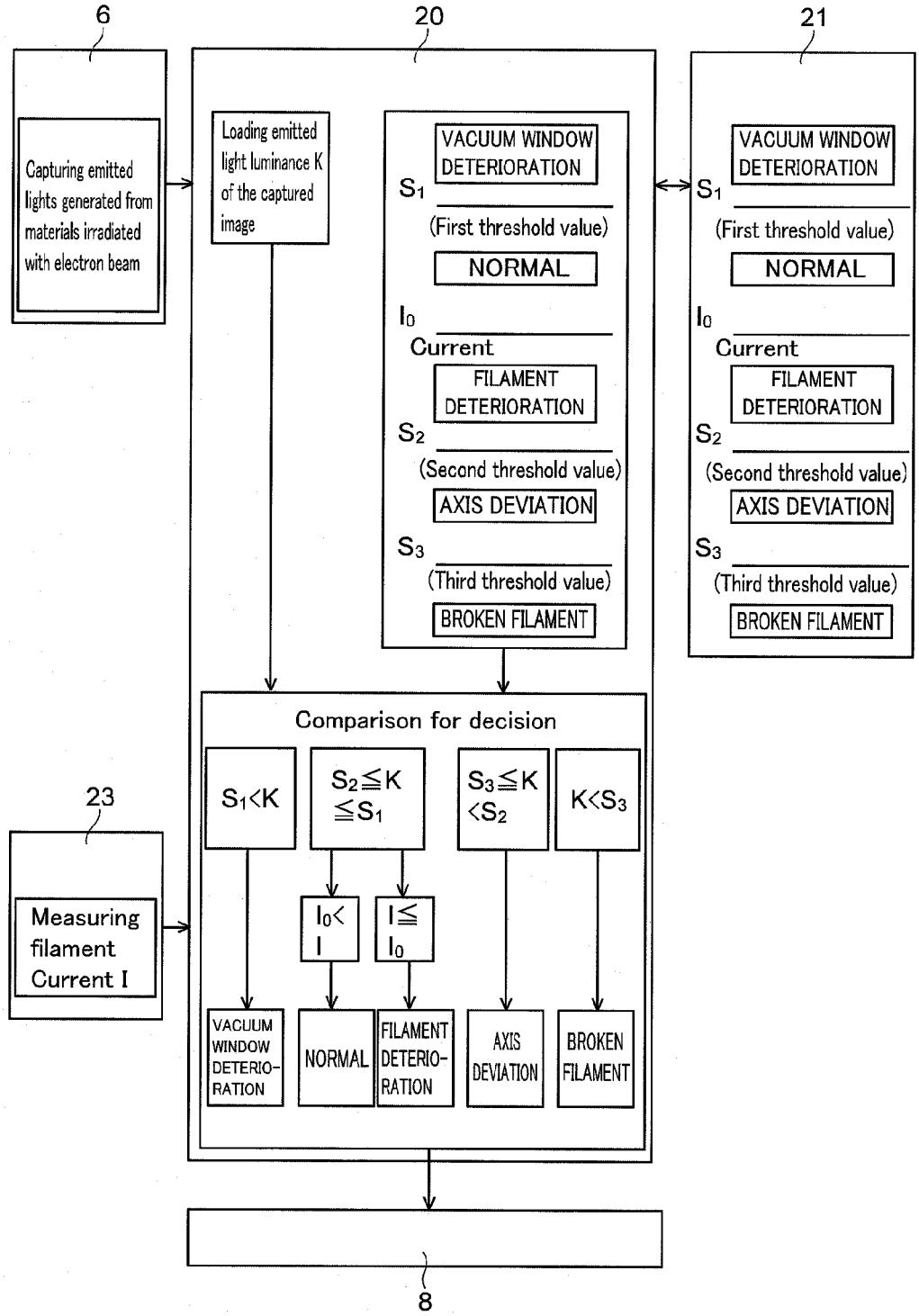
FIG. 14 is a block diagram to describe the monitoring device used in the electron beam irradiation apparatus with monitoring device in Embodiment 6 of the present invention.

As indicated in FIG. 14, the storage means 21 stores the state of filament deterioration and the current setting I0. The current setting I0 is set at such a value as is equal to or larger than the filament current that causes the filament deterioration but smaller than the filament current that appears when the electron beam is irradiated normally. In setting the current setting I0, it is preferable to make the filament currents in the filament deterioration and under the normal state grasped. It is feasible to set the current setting I0 at a value 0.9 times the initial current of the filament.

In this embodiment, the constant voltage controlled filament power supply is used. Therefore, an insufficient electron beam irradiation occurs when the filament deteriorates due to long-year use since the deterioration causes the increased resistance of the filament and consequently invites decrease in the filament current. Further, this embodiment employs a control means; therefore, the electron beam irradiation same as under the normal state can be maintained by regulating the grid voltage with the control means even when the filament deterioration occurs more or less. When the filament deterioration develops into a degree that the control means cannot control, the calculating means 20 decides that the state is being filament deterioration based on the result of comparison with the current setting I0. In this event, the emitted light luminance becomes dark compared with the state under the normal working order because the filament deterioration reduces amount of thermal electrons that could have been emitted although the grid voltage is regulated to its available maximum by the control means.

In the decision of the filament deterioration, the calculating means 20 loads the emitted light luminance K of the image captured by the photographing means 6 to compare with the first threshold value S1 and the second threshold value S2. When the emitted light luminance K is equal to or higher than the second threshold value S2 and is equal to or lower the first threshold value S1, the calculating means 20 loads the filament current I from the ammeter 23 to compare the loaded filament current I with the current setting I0 stored in the storage means 21. When the comparison indicates that the filament current I is equal to or smaller than the current setting I0, the calculating means 20 reads in the state of the filament deterioration stored in the storage means 21 to decide that the state of electron beam irradiation is being filament deterioration. When, in contrast, the filament current I is larger than the current setting I0, the calculating means 20 reads in the state of normal stored in the storage means 21 to decide that the state of electron beam irradiation is normal. Then, the result of the decision is transferred to the display means 8 to permit outputting.

Figure 15:
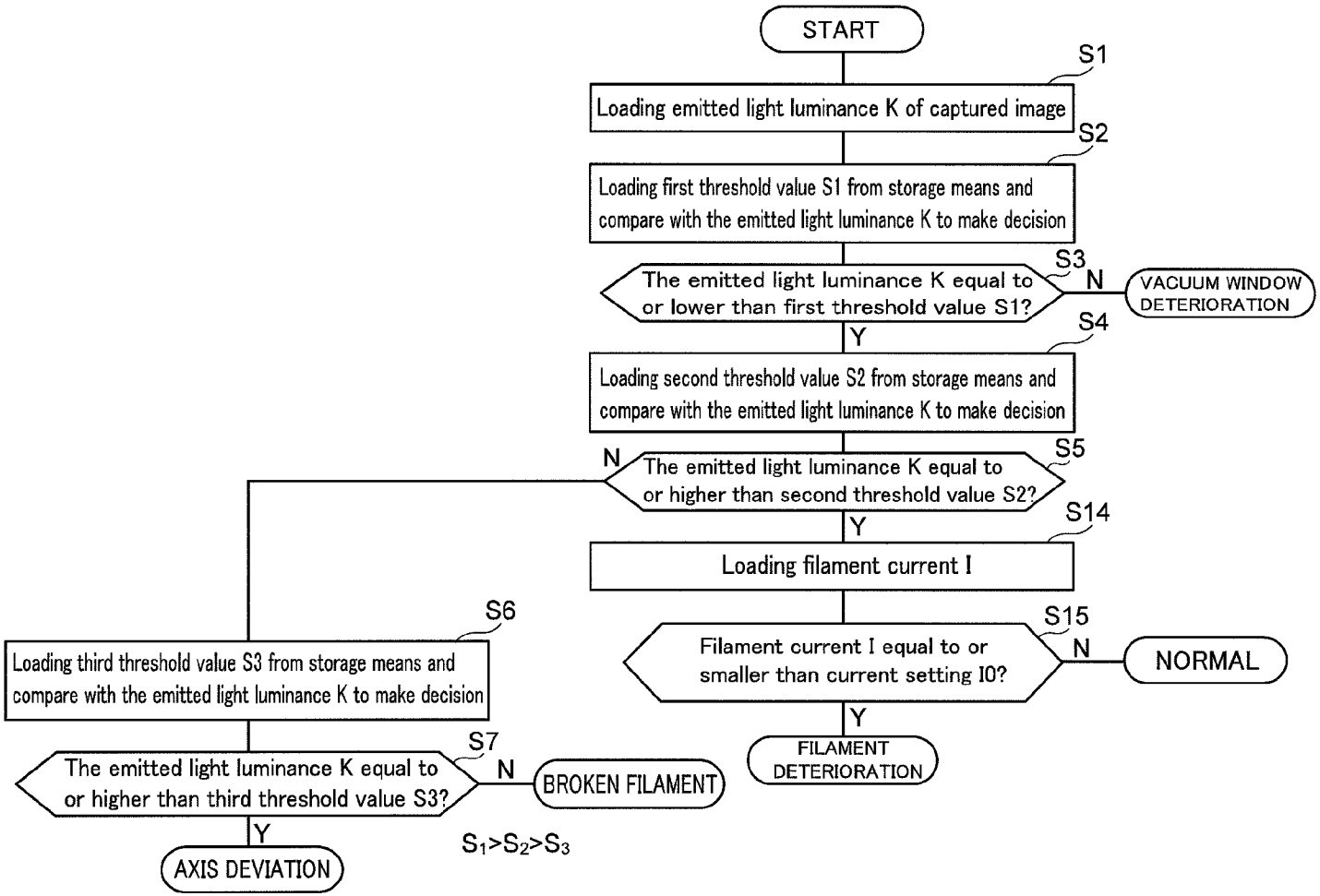
FIG. 15 is a flowchart to describe details of the processing in the calculating means indicated in FIG. 14.

Explanation follows referring to FIG. 15, a flowchart indicating details of processing steps in the calculating means 20. The elements same as those in FIG. 5, 7, 9, 11, or 13 are assigned the same signs used in such figures and explanation is omitted for those portions that have appeared in these figures.

When the calculating means 20 finds in the processing step S5 that the emitted light luminance K is equal to or higher than the second threshold value S2, the calculating means 20 loads the filament current I from the ammeter 23 (S14). Then, the calculating means 20 decides whether or not the loaded filament current I is equal to or smaller than the current setting I0 stored in the storage means 21 (S15). When the filament current I is equal to or smaller than the current setting I0, the calculating means 20 reads in the state of "filament deterioration" from among states of electron beam irradiation stored in advance in the storage means 21 to decide that the state of electron beam irradiation is being filament deterioration. When, in contrast, the filament current I is not equal to nor smaller than the current setting I0, the calculating means 20 reads in "normal" from among the states of filament deterioration stored in advance in the storage means 21 to decide that the state of electron beam irradiation is normal.

Embodiment 7

Figure 16:
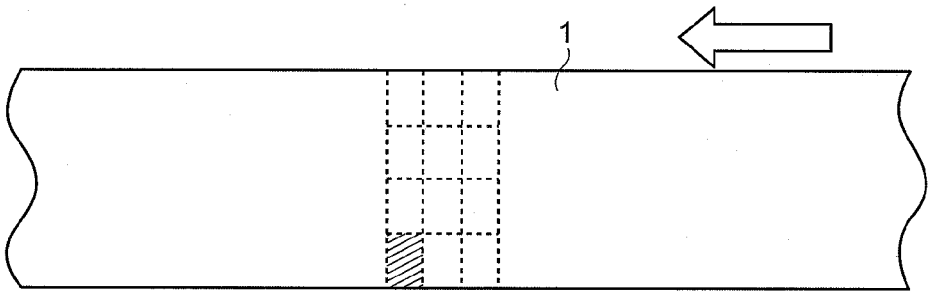
FIG. 16 is a plane view of an image loaded by the calculating means from the image captured by the photographing means used in the electron beam irradiation apparatus with monitoring device of Embodiment 7 of the present invention.

Embodiment 7 is an example in which the calculating means 20 divides the image captured by the photographing means 6 into plural segments and loads the emitted light luminance of each segment. FIG. 16 is a plane view of the plastic film 1 captured by the photographing means 6, in which the image is divided by the calculating means 20 into 12 segments. The plastic film 1 is conveyed in the arrow-indicated direction illustrated in FIG. 16 and, above the plastic film 1 that is divided into segments, the electron beam irradiation means 4 (not shown) is provided. The calculating means 20 loads the emitted light luminance K from each of the segments and compares with the threshold values stored in the storage means 21 to permit grasping the emitted light luminance K of every segment. Thus, it is enabled to keep track of the location of irregularity in detail in correspondence with each of the segments on occurrence of abnormality in the state of electron beam irradiation. The shaded portion in FIG. 16 denotes the emitted light luminance K when a broken filament occurs expressing that the filament above such segment is broken. In this embodiment, the number of segments is 12, which is an explanatory example. The number of segments can be varied properly according to the width or conveying speed of the plastic film 1.

Embodiment 8

Embodiment 8 is an example of arrangement of the photographing means 6. Explanation of this example follows referring to FIGS. 17 to 19. The elements same as those in FIG. 1 and FIG. 2 are assigned the same signs used in such figures and explanation is omitted for those portions that have appeared in these figures.

Figure 17:
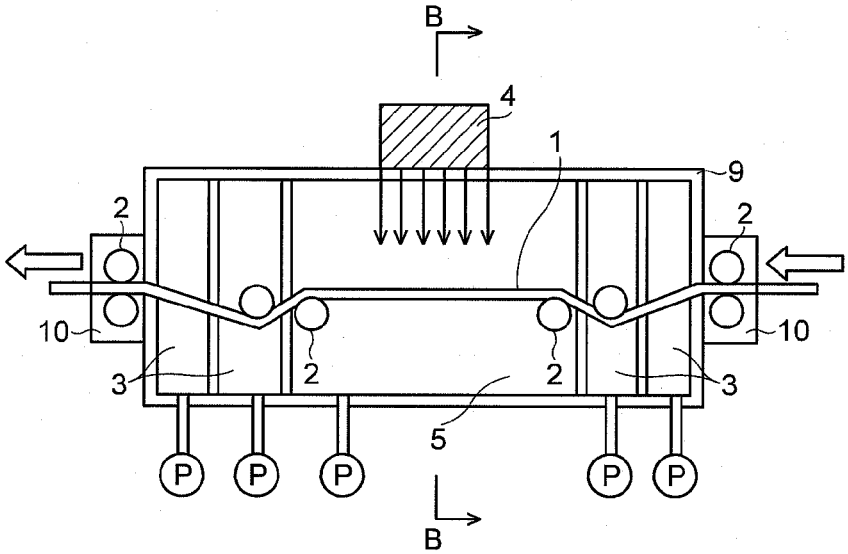
FIG. 17 is a schematic sectional side view of an electron beam irradiation apparatus with monitoring device to illustrate Embodiment 8 of the present invention.

As illustrated in FIG. 17, the observation window 7 and the space enveloped by metal such as stainless steel, which are provided inside the irradiation chamber 5 for accommodating the photographing means 6, are provided outside the irradiation chamber 5, i.e., on near side of the illustration.

Figure 18:
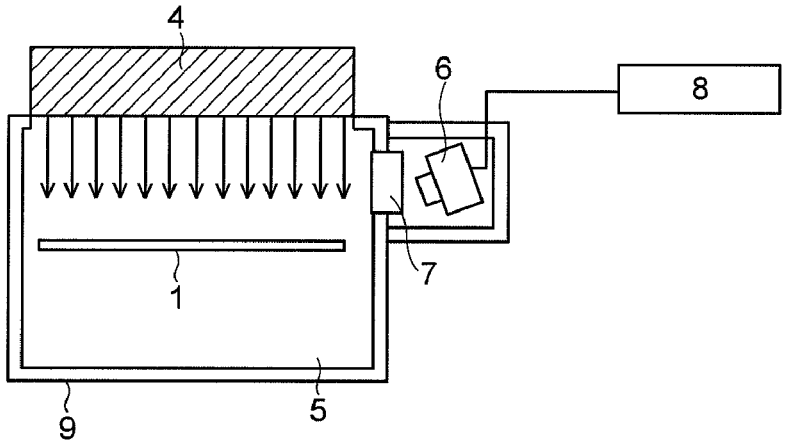
FIG. 18 is a vertical sectional view of the apparatus illustrated in FIG. 17 sectioned along the line B-B in FIG. 17.
Figure 19:
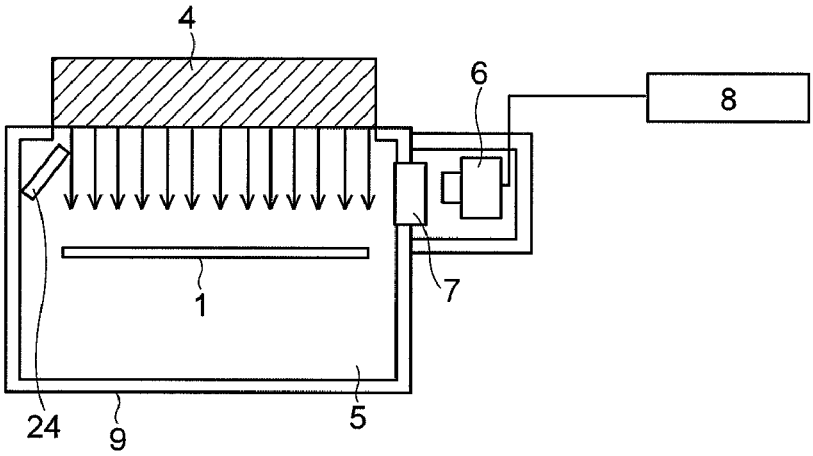
FIG. 19 is a vertical sectional view of the apparatus of Embodiment 8 of the present invention indicated in FIG. 17 sectioned along the line B-B in FIG. 17, in which the sectional figure illustrates a modified implementation of Embodiment 8.

FIG. 18 is a vertical sectional view of the apparatus illustrated in FIG. 17 sectioned along the line B-B in FIG. 17. The figure illustrates the aspect in which the plastic film 1 is irradiated in the irradiation chamber with electron beam emitted from the electron beam irradiation means 4. As illustrated in FIG. 18, the space for accommodating the photographing means 6 is arranged in a position parallel to the side face of the carrier path 9. In the arrangement illustrated in FIG. 1, the photographing means 6 captures the emitted light through the observation window 7 from the position that fronts the conveying direction of the plastic film 1. In the arrangement illustrated in FIG. 18 in contrast, the photographing means 6 captures the emitted light through the observation window 7 from the position that faces perpendicularly to the conveying direction of the plastic film 1. Providing the accommodation space for the photographing means 6 in this position makes installation of the accommodation space for the photographing means 6 easy compared to providing the accommodation space for the photographing means 6 inside the irradiation chamber 5 under a reduced-pressure state, because it is enough to consider the airtightness of only the observation window 7. It is preferable to install the photographing means 6 on the position obliquely above the plastic film 1 to permit capturing the entire width of the plastic film 1. Where width of the plastic film 1 is broad, image capturing across its width will encounter difficulty. In this event, it is more preferable to provide a mirror 24 in a manner as illustrated in FIG. 19. When the mirror 24 is used, the photographing means 6 directs its lens toward the mirror 24 through the observation window 7 to capture the emitted lights reflected at the mirror 24. In this case, the mirror 24 is installed tilted so that the emitted lights from the plastic film 1 can be captured.

The invention claimed is:

1. An electron beam irradiating apparatus with monitoring device, comprising:

an electron beam irradiation means irradiating materials in an irradiation chamber with an electron beam, the electron beam being generated by accelerating thermal electrons, the thermal electrons being emitted from a plurality of filaments;

a photographing means capturing lights emitted by the irradiated materials;

a storage means storing states of the electron beam irradiation in advance; and a calculating means processing an image captured by the photographing means to decide the state of electron beam irradiation stored in the storage means, wherein the storage means stores luminance of the images that correspond to the states of electron beam irradiation, and stores at least three states of electron beam irradiation selected from a group consisting of normal, axis deviation, broken filament, and vacuum window deterioration, and the calculating means loads the image captured by the photographing means to compare the loaded image with the luminance of the image stored in the storage means, reads the states of electron beam irradiation related to the luminance of images stored in the storage means, and thereby decides the state of electron beam irradiation.

2. The electron beam irradiating apparatus with monitoring device according to claim 1, wherein the calculating means divides the image captured by the photographing means into a plurality of segments and compares the emitted light luminance of the each segment with the threshold value stored in the storage means.

3. An electron beam irradiating apparatus with monitoring device, comprising:

an electron beam irradiation means irradiating materials in an irradiation chamber with an electron beam, the electron beam being generated by accelerating thermal electrons, the thermal electrons being emitted from a plurality of filaments;

a photographing means capturing lights emitted by the irradiated materials;

a storage means storing states of electron beam irradiation in advance; and a calculating means processing an image captured by the photographing means to decide the state of electron beam irradiation stored in the storage means, wherein the storage means stores a first threshold value that is set at the maximum value of the emitted light luminance when the electron beam is irradiated normally;

a second threshold value that is set at the minimum value of the emitted light luminance when the electron beam is irradiated normally, and is set at higher value than the emitted light luminance when the electron beam is irradiated with axis deviation;

a third threshold value that is set at lower than the second threshold value, is set at higher value than the emitted light luminance when the electron beam is irradiated with broken filament, and is set to the minimum value of the emitted light luminance when the electron beam is irradiated with axis deviation; and at least three states of electron beam irradiation selected from a group consisting of normal, axis deviation, broken filament, and vacuum window deterioration are stored, and the each state corresponds to state areas of the storage means that are divided by the three threshold values;

the calculating means loads the value of the emitted light luminance of the image captured by the photographing means to compare the loaded luminance value with each of the threshold values stored in the storage means, reads the state of electron beam irradiation stored in the storage means when the loaded luminance value is equal to or higher than the second threshold value and equal to or lower than the first threshold value, and decides that the state of electron beam irradiation is normal, reads the state of electron beam irradiation stored in the storage means when the loaded luminance value is lower than the second threshold value and equal to or higher than the third threshold value, and decides that the state of electron beam irradiation is axis deviation, and decides that the state of electron beam irradiation is broken filament among the states of electron beam irradiation stored in the storage means when the loaded luminance value is lower than the third threshold value.

4. The electron beam irradiating apparatus with monitoring device according to claim 3, wherein the storage means stores a first threshold value that is set at the maximum value of the emitted light luminance when the electron beam is irradiated normally, and is set at lower value than the emitted light luminance when the electron beam is irradiated with the state of vacuum window deterioration, and the storage means also stores the states of electron beam irradiation each of which represents normal, axis deviation, broken filament, and vacuum window deterioration; and the calculating means reads the state of electron beam irradiation stored in the storage means when the value of the emitted light luminance of the image captured by the photographing means is higher than the first threshold value and decides that the state of electron beam irradiation is vacuum window deterioration.

5. The electron beam irradiating apparatus with monitoring device according to claim 4, wherein the electron beam irradiation means has a constant current controlled filament power supply and a voltmeter, the constant current controlled filament power supply being connected to a plurality of the filaments, the voltmeter measuring the filament voltage;

the storage means stores a voltage setting that is higher than the filament voltage of the vacuum window deterioration and is equal to or lower than the filament voltage of the filament deterioration, and the storage means also stores the states of electron beam irradiation each of which represents normal, axis deviation, broken filament, vacuum window deterioration, and filament deterioration; and the calculating means loads the filament voltage from the voltmeter when the value of the emitted light luminance of the image captured by the photographing means is higher than the first threshold value to compare with the voltage setting stored in the storage means and decides that the state of electron beam irradiation is the filament deterioration when the loaded filament voltage is equal to or higher than the voltage setting.

6. The electron beam irradiating apparatus with monitoring device according to claim 5, wherein the voltage setting stored in the storage means is set 1.1 times the initial filament voltage.

7. The electron beam irradiating apparatus with monitoring device according to claim 4, wherein the electron beam irradiation means has a constant voltage controlled filament power supply and an ammeter, the constant voltage controlled filament power supply being connected to a plurality of the filaments, the ammeter measuring the filament current;

the storage means stores a current setting that is equal to or larger than the filament current of the filament deterioration and is smaller than the filament current of the axis deviation, and the storage means also stores the states of electron beam irradiation each of which represents normal, axis deviation, broken filament, vacuum window deterioration, and filament deterioration; and the calculating means loads the filament current from the ammeter when the value of the emitted light luminance of the image captured by the photographing means is lower than the second threshold value and equal to or higher than the third threshold value to compare with the current setting stored in the storage means and decides that the state of electron beam irradiation is the filament deterioration when the loaded current is equal to or smaller than the current setting.

8. The electron beam irradiating apparatus with monitoring device according to claim 7, wherein the current setting stored in the storage means is set 0.9 times the initial filament current.

9. The electron beam irradiating apparatus with monitoring device according to claim 4, wherein the electron beam irradiation means has a constant current controlled filament power supply, a voltmeter, a grid, and a control means, the constant current controlled filament power supply being connected to a plurality of the filaments, the voltmeter measuring the filament voltage, the grid being connected to a grid power supply oppositely facing the filament, and the control means controlling the amount of thermal electrons emitted from the filament by regulating the voltage of the grid power supply;

the storage means stores a voltage setting that is higher than the filament voltage of the normal and is equal to or lower than the filament voltage of the filament deterioration, and the storage means also stores the states of electron beam irradiation each of which represents normal, axis deviation, broken filament, vacuum window deterioration, and filament deterioration; and the calculating means loads the filament voltage from the voltmeter when the value of the emitted light luminance of the image captured by the photographing means is equal to or higher than the second threshold value and equal to or lower than the first threshold value to compare with the voltage setting stored in the storage means and decides that the state of electron beam irradiation is being filament deterioration when the loaded voltage is equal to or higher than the voltage setting.

10. The electron beam irradiating apparatus with monitoring device according to claim 4, wherein the electron beam irradiation means has a constant voltage controlled filament power supply, an ammeter, a grid, and a control means, the constant voltage controlled filament power supply being connected to a plurality of the filaments, the ammeter measuring the filament current, the grid being connected to a grid power supply oppositely facing the filament, the control means controlling the amount of thermal electrons emitted from the filament by regulating the voltage of the grid power supply;

the storage means stores a current setting that is equal to or larger than the filament current of the filament deterioration and smaller than the filament current of the normal, and the storage means also stores the states of electron beam irradiation each of which represents normal, axis deviation, broken filament, vacuum window deterioration, and filament deterioration; and the calculating means loads the filament current from the ammeter when the value of the emitted light luminance of the image captured by the photographing means is higher than the first threshold value to compare with the current setting stored in the storage means and decides that the state of electron beam irradiation is filament deterioration when the loaded current is equal to or smaller than the current setting.

* * * * *